US005173058A

United States Patent [19]

Broeksteeg et al.

[11] Patent Number: 5,173,058

[45] Date of Patent: Dec. 22, 1992

[54] ZERO INSERTION FORCE ELECTRICAL CONNECTOR

[75] Inventors: Johannes M. Broeksteeg, Ag Oss; Lucas Soes, Rosmalen, both of Netherlands

[73] Assignee: AMP Incorporated, Harrisburg, Pa.

[21] Appl. No.: 348,612

[22] Filed: May 5, 1989

[30] Foreign Application Priority Data

May 5, 1988 [GB] United Kingdom ..... 8810581

[51] Int. Cl.[5] ..... H01R 11/22

[52] U.S. Cl. ..... 439/267; 439/329; 439/493

[58] Field of Search ..... 439/259, 260, 261, 262, 439/263, 264, 265, 266, 267, 268, 329, 493, 632, 59, 65, 67

[56] References Cited

U.S. PATENT DOCUMENTS

| | | | |
|---|---|---|---|
| 3,636,499 | 1/1972 | Winklebleck | 439/260 |
| 3,638,167 | 1/1972 | Occhipinti et al. | 439/267 |
| 3,665,370 | 5/1972 | Hartmann | 439/360 |
| 3,977,747 | 8/1976 | Broutros | 439/267 |
| 4,072,379 | 2/1978 | Towne et al. | 439/65 |
| 4,119,357 | 10/1978 | Bonhomme | 439/260 |
| 4,189,200 | 2/1980 | Yeager et al. | 439/267 |
| 4,252,392 | 2/1981 | Whiteman, Jr. | 439/267 |
| 4,266,839 | 5/1989 | Aikens | 439/260 |
| 4,478,471 | 10/1984 | Olsson | 439/267 |
| 4,483,578 | 11/1984 | Masahiro | 439/325 |
| 4,541,678 | 9/1985 | Lumpp | 439/260 |
| 4,576,427 | 3/1986 | Verbruggen | 439/592 |
| 4,639,063 | 1/1987 | Mueller | 439/325 |
| 4,759,726 | 7/1988 | Naylor et al. | 439/441 |
| 4,778,403 | 10/1988 | Ikesugi et al. | 439/329 |

FOREIGN PATENT DOCUMENTS

| | | |
|---|---|---|
| 0068195 | 1/1983 | European Pat. Off. . |
| 0141539 | 5/1984 | European Pat. Off. . |
| 0189234 | 1/1986 | European Pat. Off. . |
| 0263296 | 8/1987 | European Pat. Off. . |
| 2739645 | 3/1978 | Fed. Rep. of Germany . |
| 2834728 | 2/1980 | Fed. Rep. of Germany . |
| 2278222 | 7/1974 | France . |

OTHER PUBLICATIONS

Elonco Bulletin, vol. 26, Mar. 1964, p. 22.

*Primary Examiner*—Neil Abrams
*Assistant Examiner*—Khiem Nguyen
*Attorney, Agent, or Firm*—Bruce J. Wolstoncroft

[57] ABSTRACT

An electrical connector is disclosed which can electrically terminate flexible cable to a printed circuit board. The connector includes an insulating housing having a plurality of terminals which extend forwardly towards the front face. The terminals are each provided with horizontal base sections, and a retention leg. The terminals include first contact portions. The terminals further comprise spring portions having a second contact portion opposed from the first contact portion. A lever section extends from the spring portion. A cam actuator is installed on the connector housing with individual cam sections aligned with, and below, the lever sections of the terminals. The cam actuator is rotatable relative to the housing to cam the terminals open for insertion of the conductors.

10 Claims, 22 Drawing Sheets

100
402
106

ZERO INSERTION FORCE ELECTRICAL CONNECTOR

BACKGROUND OF THE INVENTION

1. Field of the Invention

The subject invention relates to a zero insertion force electrical connector for interconnecting electrical conductors to circuitry on a printed circuit board.

A need exists within the electronics industry for direct connection of conductors to the printed circuit board. This connector should also provide for easy insertion and withdrawal of the conductors.

Multiconductor cable and flexible printed circuits are interconnected to printed circuit boards for the distribution of dc power to the printed circuit boards and for data distribution to and from the circuitry on the printed circuit boards. Typically, the conductors are interconnected to an electrical female connector similar to those shown in U.S. Pat. Nos. 4,435,035 and 4,062,610; or in International Patent Application Number PCT/US86/01942 which is Publication Number WO87/01870; while a male post header is electrically interconnected to the printed circuit board. While this system is suitable for many such interconnections, the finished cost is increased by the inclusion of the male header. Therefore, there exists within the electronics industry a need for an electrical connector which will be suitable for mounting on the printed circuit board without the requirement for the male header; in other words, a connector where the electrical conductors can be directly interconnected to the connector.

A connector designed for the above mentioned application has a number of desired features. One desired feature is for improved mechanical advantage to lift the contacts from an opposed to an open position. The terminals should also be prestressed to allow maximum contact force on the electrical conductors. Another is to provide an electrical connector having a detent position where the contacts can be opened to a position where the contacts remain open for insertion of the flexible cable. This will require only one hand for insertion of the flexible cable.

The connector design should also be versatile, where the housing and basic terminal design can be used for a number of configurations. The connector should be available in a low height version for packaging purposes, or be in a vertical standing relation where access is a problem. The connector should also accommodate individual conductors of a multiconductor flat cable, printed circuit boards, or flexible printed circuitry. Finally, the design should be versatile enough to include electrical shielding.

One connector is shown in EP Publication 0 263 296 where the flexible circuit can be placed in the front face of the connector, and interconnected to a printed circuit board. In this connector, an upper cover is rotatable about the housing and a front nose of the cover lifts the contacts out of contact. This embodiment, while meeting some of the industry requirements, also has several disadvantages. First, the cover is placed on the top face of the connector which actually raises the vertical dimension further. Second, the cover is a lever, or fulcrum, which requires that the back portion of the cover must be pressed down in order to lift the contacts for insertion of the flexible cable. This requires that both hands are required for insertion of the cable, which, depending on available space within the electronics area, may not be available. Third, due to the small amount of vertical downward movement available, the connector does not provide much mechanical advantage for lifting the contacts, which again, may require for an awkward and difficult insertion of the wires or printed circuits. Lastly, this design does not allow for a variety of configurations. For example, this design could not be used, if desired, with the vertical arrangement, if needed. Also, this design does not lend itself well to adding features such as shielding, since so much of the upper portion of the connector must be accessible for the rotating cover.

U.S. Pat. Nos. 4,252,389 and 4,252,392 show electrical connectors which interconnect flat cable conductors to traces on printed circuit boards. These connectors also include cam members which move the cantilever springs out of contact with the cable, for installation of the cable without an insertion force. These cantilever springs do not however, contact the conductors of the flat flexible cable, but rather only spring load the conductors of the flat flexible cable into direct contact with the traces on the printed circuit board. In other words, the flat flexible cable has conductors open on one face, and that face is placed directly against the printed circuit board traces, while the spring members bias the cable towards the board. The springs never contact the conductors directly, but only the insulation which backs the conductor. While this system is usable for certain situations, this system has several limitations making it unusable for discrete solid conductors in a multi-conductor cable has heretofore required.

SUMMARY OF THE INVENTION

The above mentioned objects were accomplished by designing an electrical connector comprising an insulating housing having a plurality of terminal receiving passageways for receiving a like plurality of electrical terminals. The housing further comprises a front mating face for receipt of a flat flexible cable having conductive traces embedded thereon. The connector includes a plurality of electrical terminals wherein each of the terminals includes opposed contact portions for contacting the traces on the flexible cable. Each of the terminals has a lever portion which can be lifted by a further member, to open the opposed contact portion. The connector is characterized by having the further member defined as a cam member positioned proximate to the lever portions which is rotatable to cam the lever portions upwardly and out of contact with each other.

In the preferred embodiment of the invention, the electrical terminals are edge stamped from sheet metal, and include a base section and a movable spring portion. The base section includes an upwardly projecting contact portion defining a first contact section, and the movable spring portion includes a downwardly projecting contact portion, defining a second contact portion, opposed from the first contact section. The lever portion of the contact elements is disposed forward of the opposed contact sections and projects forwardly.

In the preferred embodiment of the invention, the cam actuator is defined as a rotatable plate fixed to a cam shaft, and the cam shaft is rotatably mounted within the housing below the lever portions. The plate section of the cam member includes a plurality of windows through the plate, such that rotation of the plate towards the ends of the lever sections allows the lever sections to pass through the windows, increasing the allowable rotation angle. Preferably, the cam shaft includes a plurality of individual cam sections aligned with the lever sections.

While the preferred embodiment of the invention relates to an unshielded version of connector, the instant design lends itself to easy modification of a shielded connector. In a shielded version of the connector, a shield member includes an upper shield wall, side shield walls and a rear shield wall. The shield member also includes a latching member which can latch the shield to the housing body.

In one aspect of the invention, the electrical connector includes resilient contact portions formed by a U-shaped contact flanking the wire access openings. Preferably, the U-shaped contact is formed by a first and second contact arm, where the second arm is movable away from the first arm to allow access into and between the said arms. Preferably, the camming means is operatively connected to said second arm, where operation of said camming means cooperates with said second arm to effect said first and second positions. Preferably, the second arm includes a second U-shaped portion, uniplanar with the first U-shaped portion, opening away from the wire receiving face. The camming means includes a shaft extending through said second U-shaped openings including an eccentric which, upon rotation of said shaft, moves said second U-shaped opening laterally away from the first said U-shaped portion. Preferably, the second U-shaped portions form bearings for the rotation of the shaft, and retain the camming means to the housing. Preferably, the camming means further comprises a handle which is operatively connected to the shaft for assisting in the rotation of the shaft.

An inventive method of manufacturing the terminals as described above is characterized by the steps of:

edge stamping the terminals to provide a horizontal base portion with a spring arm extending from the horizontal base portion and having a first contact member extending from the spring arm and towards the horizontal base portion, and having an extension arm extending from the horizontal base portion at an acute angle relative to the horizontal base portion and in an opposite direction from the spring arm, the extension arm having a second contact member thereon, which is spaced from the first contact portion; and subsequently bending the extension arm towards the spring arm to position the first and second contact portions in an opposed and facing relation.

Subsequent to the edge stamping, but prior to the bending of the extension arm, the first and second contact members are plated. Preferably, the extension arm is bent into the spring arm in a dimension which preloads the first and second contact portions against each other. Preferably a retention arm extends from the extension arm forward of the second contact member.

In the preferred embodiment of the invention, the housing has a plurality of apertures extending in the housing, where the retention arms may reside. A substrate receiving surface is integral with the housing and extends above and transverse to the apertures. The terminal receiving passageways are defined by a floor which extends beyond the aperture. The lower edge of the horizontal base portion is in abutment with the floor.

BRIEF DESCRIPTION OF THE DRAWINGS

FIG. 3 is an isometric view similar to that of FIGS. 1 and 2 showing a partial cut away view of the connector when the terminals are in an undeflected condition;

FIG. 13 is a view similar to that of FIG. 12 for surface board mounting of printed circuit boards.

FIG. 18 is an isometric view of the second embodiment of the invention showing the wire poised for receipt within the connector.

FIG. 23 is a front plan view of the terminal of the second embodiment.

DETAILED DESCRIPTION OF THE PREFERRED EMBODIMENT

Figure 1:
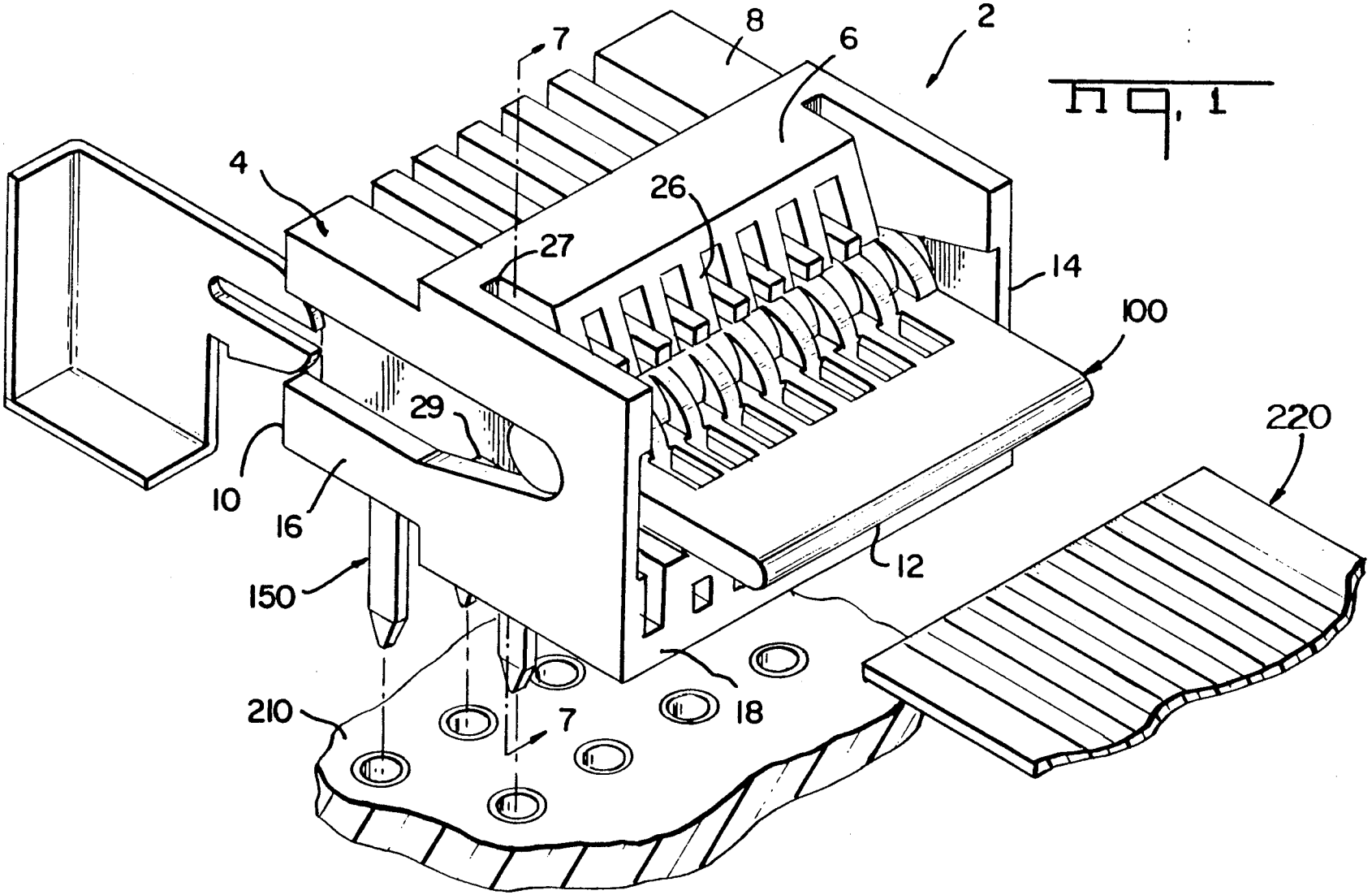
FIG. 1 is an isometric view showing the cam member and the terminals assembled to the housing.

With reference first to FIG. 1, the electrical connector 2 of the subject invention relates to a connector which can interconnect electrical traces 222 of a flat flexible cable, such as 220 to a printed circuit board 210. The electrical connector 2 generally comprises a housing 4 holding a plurality of electrical terminals 150, and further comprises a cam member 100 which can be rotated in the counter-clockwise direction (as viewed in FIG. 1) to deflect the terminals to a position where the flexible cable 220 can be inserted without an insertion force. This type of electrical connector is usually referred to as a zero insertion force or ZIF electrical connector.

Figure 2:
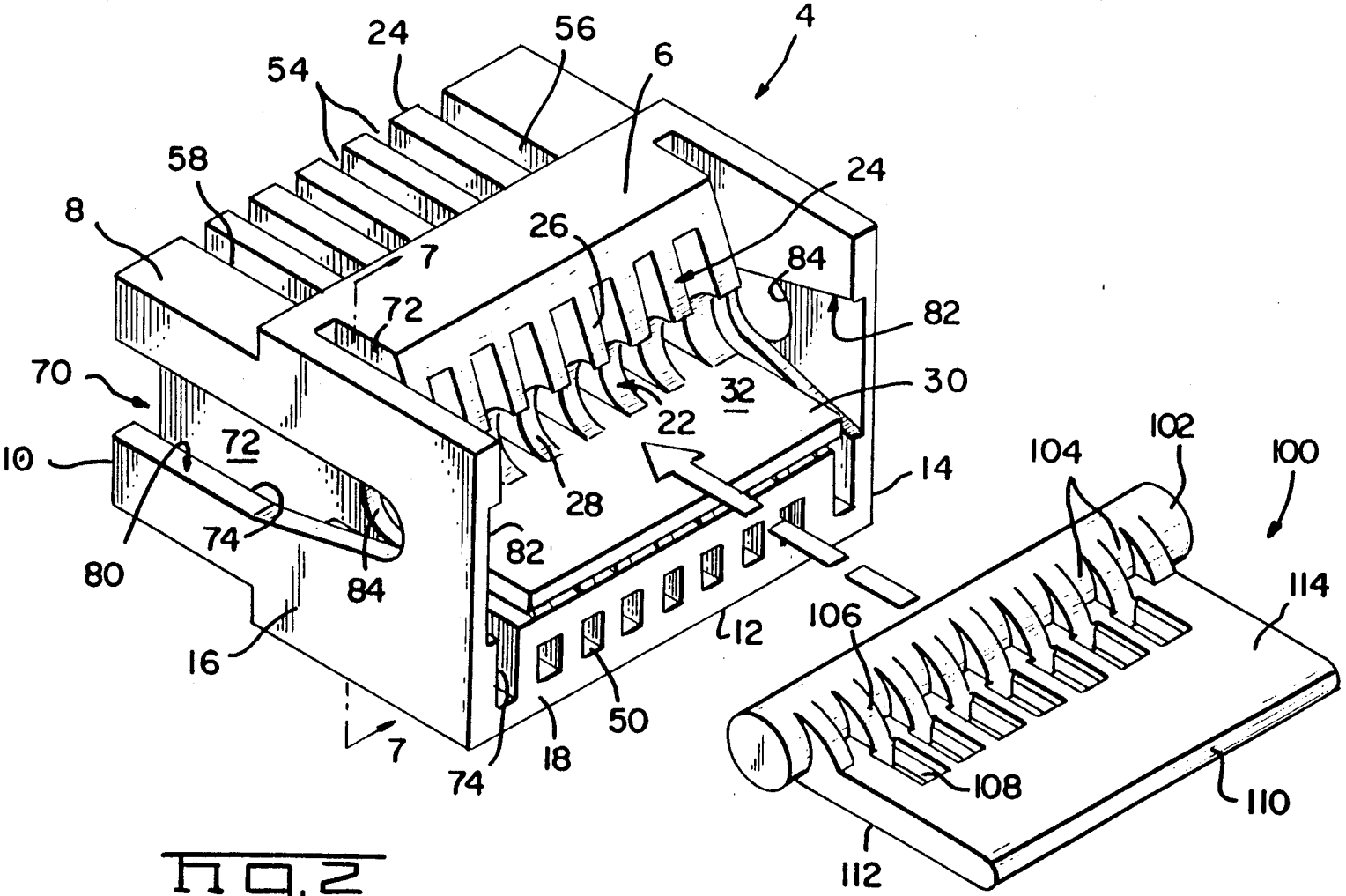
FIG. 2 is an isometric view similar to that of FIG. 1 showing the connector prior to the installation of the terminals and the cam member.

With reference to FIG. 2, the housing 4 will be described in greater detail. The housing 4 is generally comprised of an insulating material such as a glass filled thermoplastic and generally includes a top wall 6, a recessed surface 8, a rear surface 10, a lower mounting surface 12, side walls 14 and 16 and a front mating face 18. The housing further comprises a plurality of ribs 24 which extend from a position proximate the front face 18 to the rear surface 10. The profile of the ribs at the front edge is defined by slanted edges 26, and by a plurality of side by side semi-circular edges 28. The housing 4 further comprises a plurality of apertures 50 which are in side by side alignment with the terminal receiving cavities 54. The cavities 54 are defined by side surfaces 56 and 58 as shown in FIG. 2.

Figure 6:
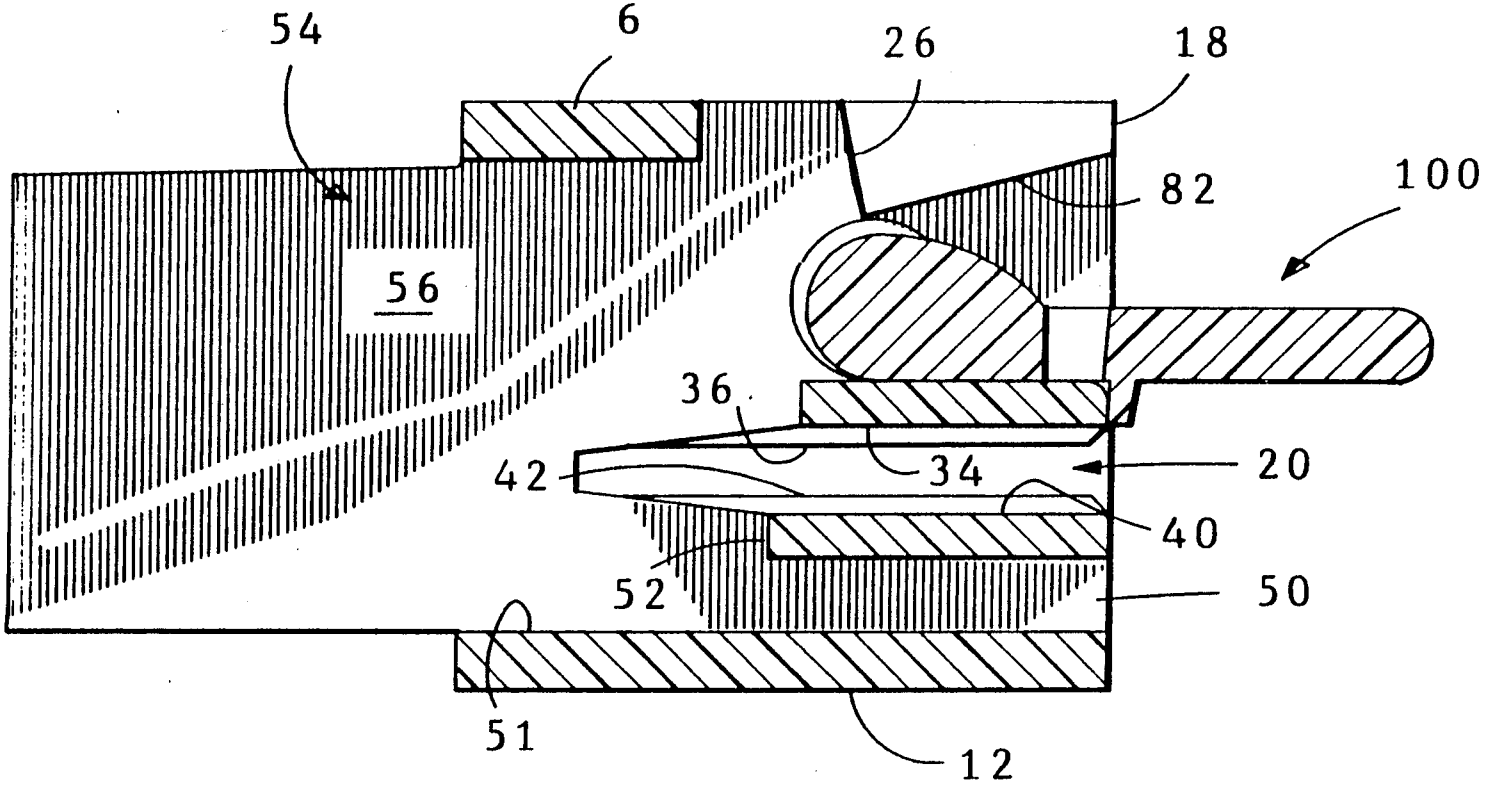
FIG. 6 is a cross-sectional view similar to that of FIG. 5 absent the electrical terminal.
Figure 7:
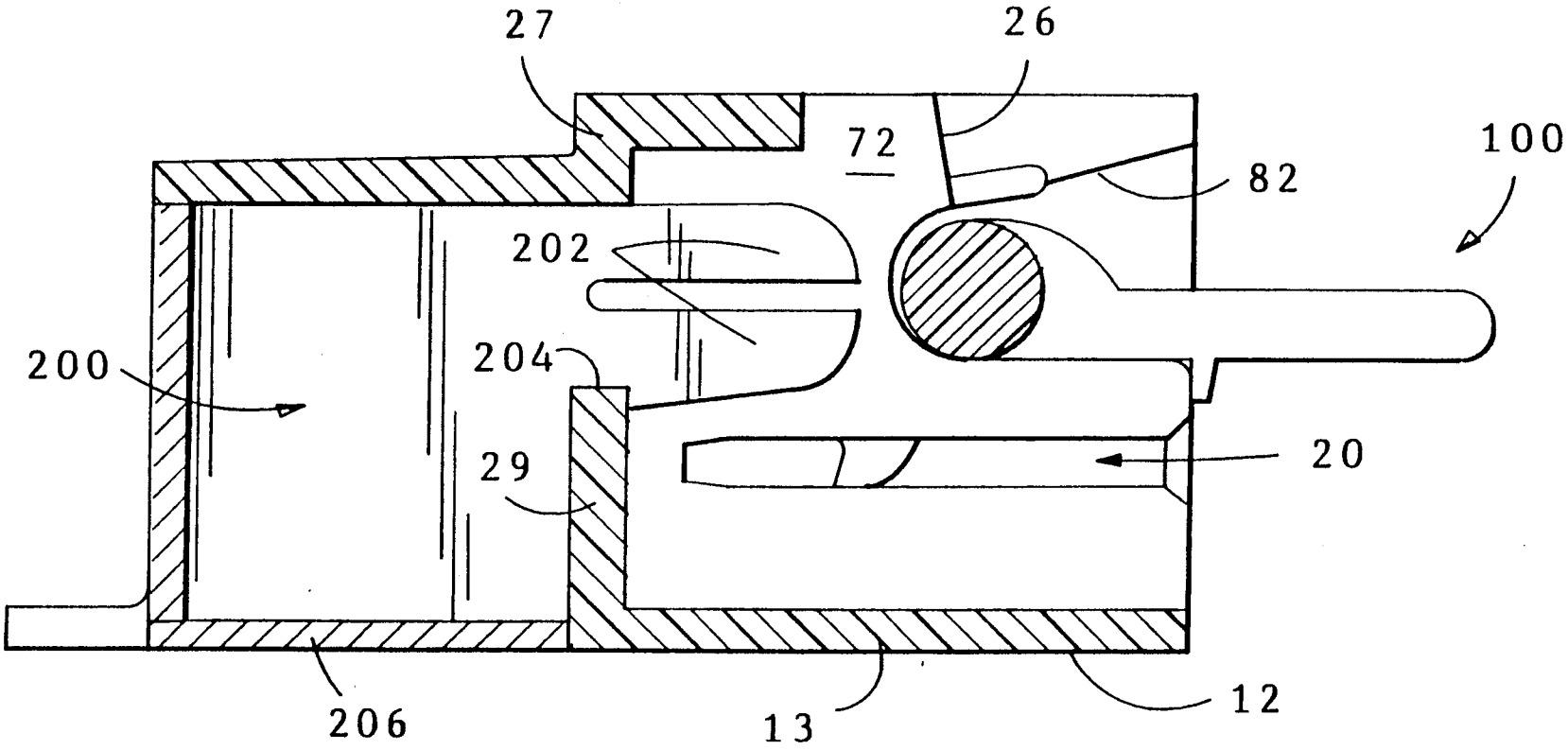

With reference now to FIG. 6, the internal features of the housing can be seen more clearly. The terminal receiving cavities 54 are defined by side surfaces 56 and 58 where the side surface 56 is co-planar with the side of the aperture 50 and with the side surfaces of the ribs 24. Although the side surface 56 is shown, due to the positioning of the cross-section, it should be appreciated that side surface 58 is a mirror image of the cross-section shown in FIG. 6, and having the same co-planarity.

Figure 4:
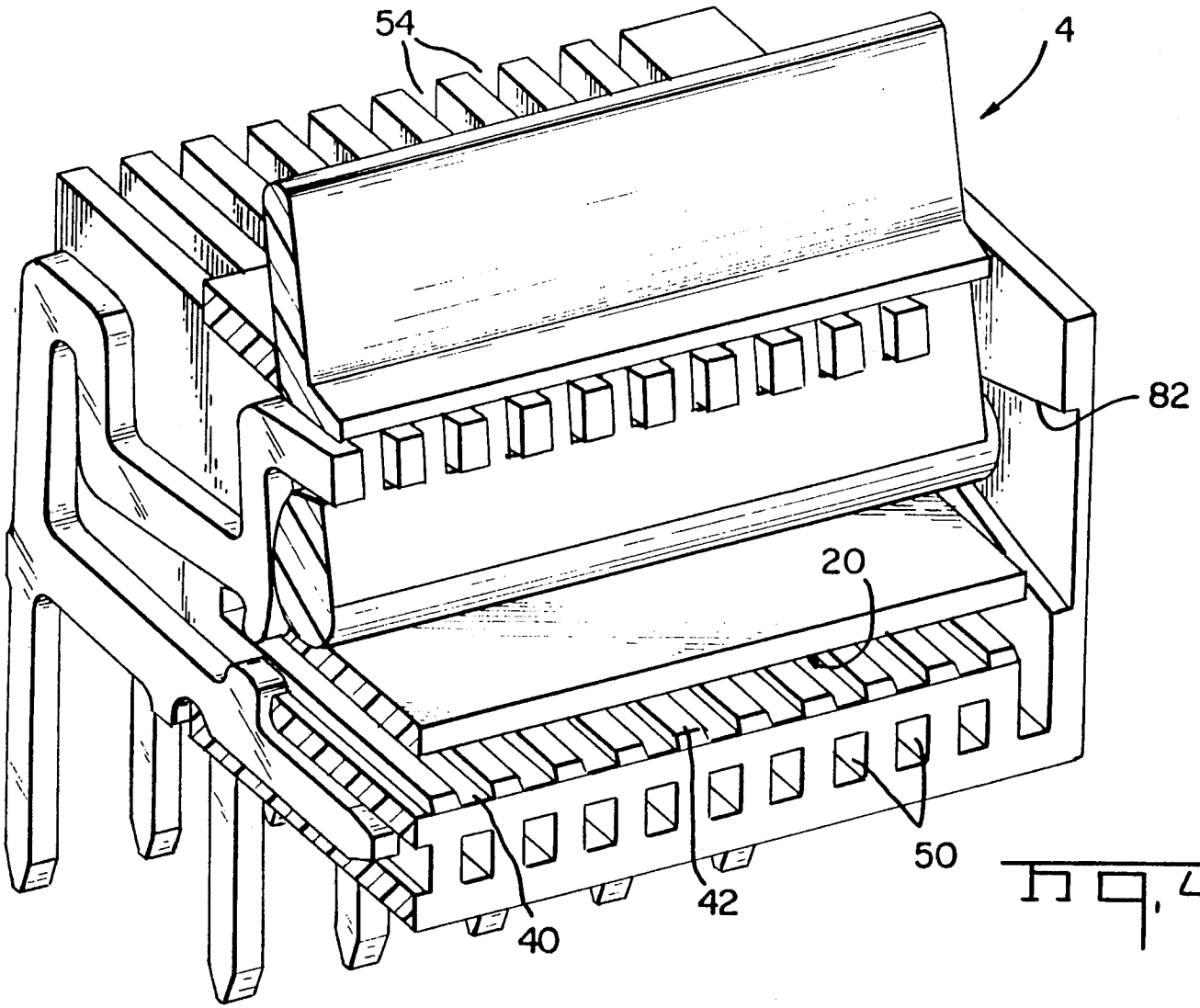
FIG. 4 is an isometric view similar to that of FIG. 3 showing the cam member in a fully rotated position with the contacts deflected and poised for receipt of a flat cable.
Figure 8:
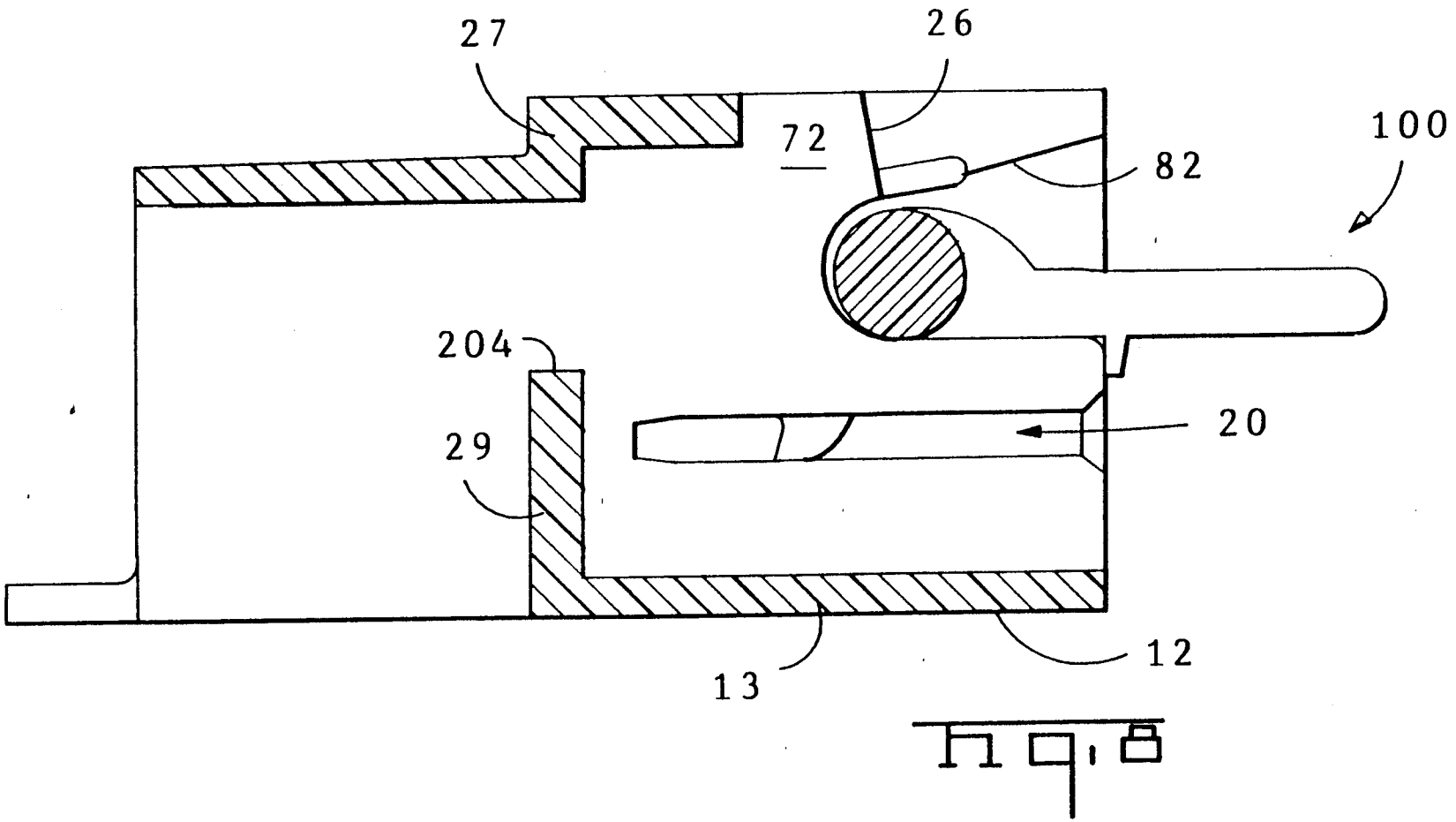
FIG. 8 is a cross-sectional view similar to that of FIG. 7 absent the hold down terminal.

With reference now to FIGS. 4 and 6, the substrate receiving slot 20 can be seen as extending in a transverse direction across the front face 18 of the housing 4. The slot is defined by an upper surface 34 and a lower surface 40, and further defined by a plurality of elongate longitudinal ribs 36 and 42. The ribs 36 and 42 are alternately spaced according to the location of the terminals as best shown in FIG. 4, and help to align the vertical position of the substrate with the contact portions of the terminals. With reference again to FIG. 2, the housing 4 includes apertures 84 therethrough for retaining the cam member 100 to the housing body. The apertures 84 are defined by two cut-out sections 80 and 82 which are laterally offset from one another and opening in opposite directions. Stated differently, the apertures 84 are created by two retractable mold parts which, when fully inserted, are flush to one another thereby forming the openings 84, and when retracted, they form the cut-out sections 80 and 82. With reference now to FIGS. 2 and 8, a further slot 70 is formed behind the cut-out 80 and is defined by surfaces 72 and 74. With reference to FIG. 8, the webs 27 and 29 are shown, which retain the sidewalls 14 and 16 to the remainder of the housing body.

With reference to FIG. 2, the cam member 100 includes a cylindrical portion 102 integral with a plate portion 110. The cam member 100 includes a plurality of side by side individual cam members 106 having arcuate surfaces 104 between each of the individual cam members 106. The plate member 110 includes an upper 114 and lower 112 surface, and a window 108 aligned with each of the cam members 106.

Figure 9:
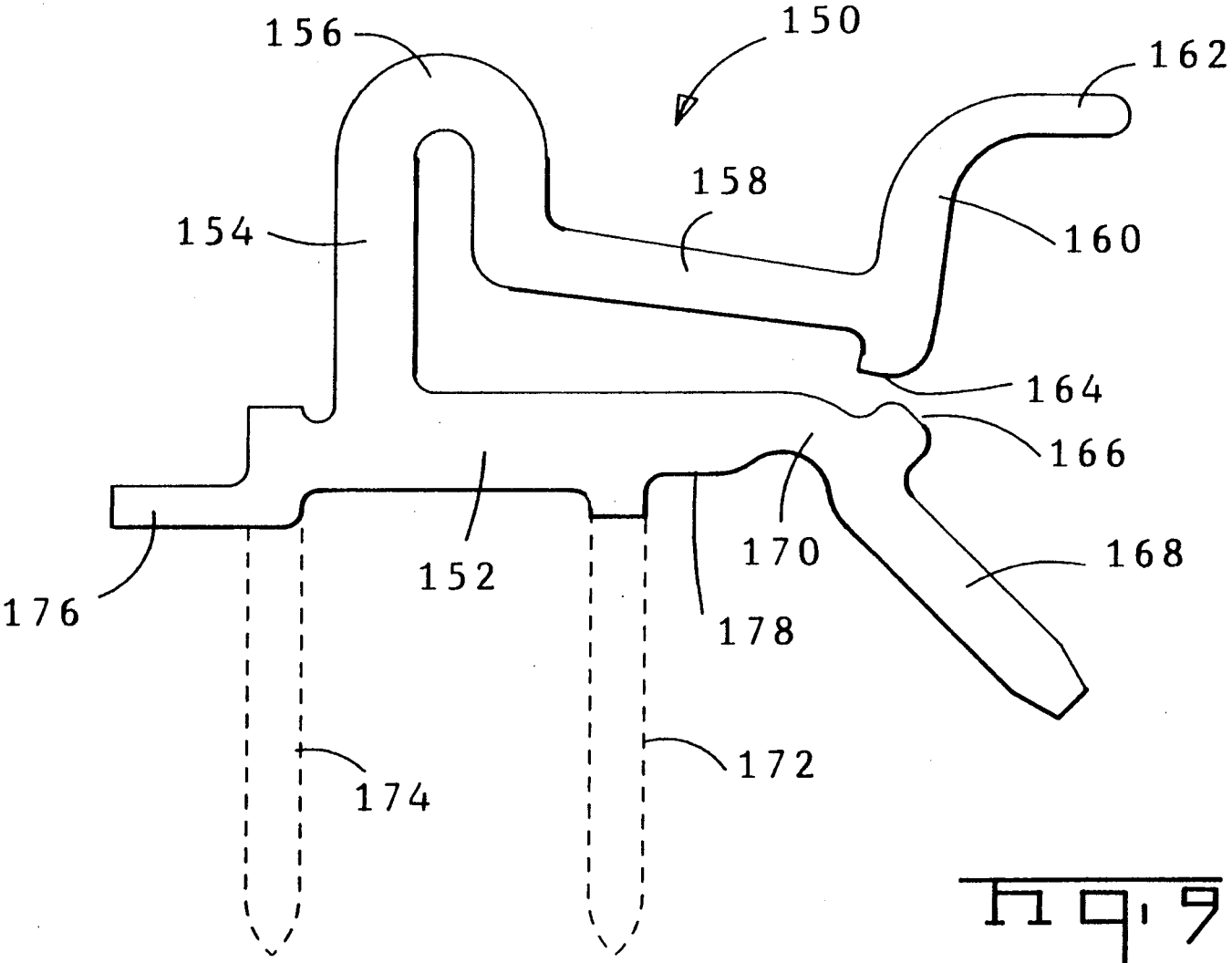
FIG. 9 is side plan view of the electrical terminal prior to the final formation.
Figure 10:
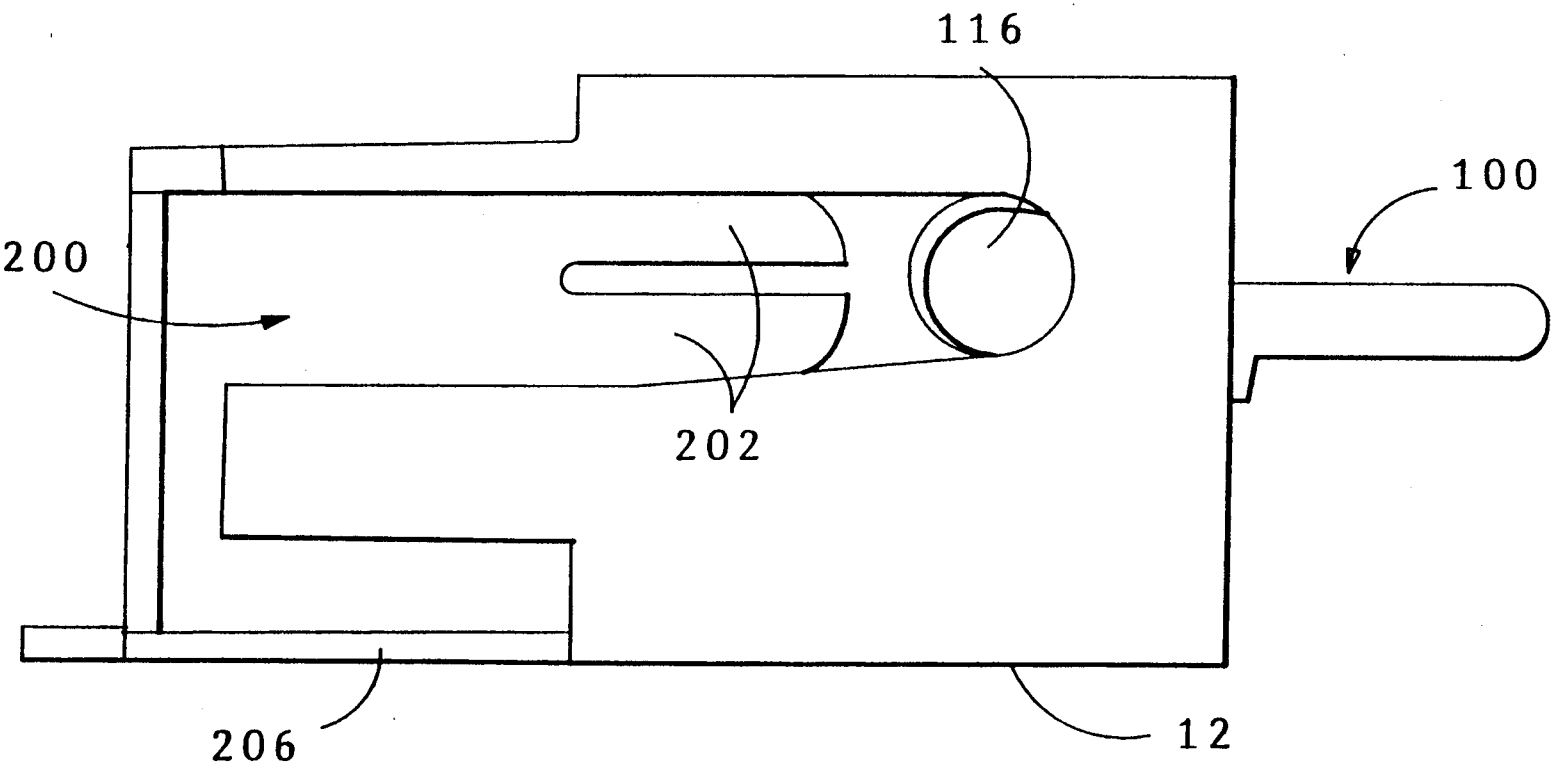
FIG. 10 is a side plan view of the electrical connector configured for surface mount applications.

With reference now to FIG. 9, a terminal 150 is shown as including a horizontal base section 152 having contact parts 172 and 174 extending therefrom in a vertical direction and a surface mount portion 176 extending in a horizontal direction from the base portion 152. The contact parts 172, 174 or 176 can be selectively retained depending on the type of electrical connection desired to the printed circuit board. A retention arm 168 extends from the front portion of the horizontal base section 152 and includes a first contact portion 166. A vertical leg 154 extends upwardly from the horizontal base portion 152 and is continuous through a U-shaped section 156 to a contact arm section 158. A lever arm 162 is continuous with the contact arm 158 and has at its lower section, a second contact portion 164.

To assemble the connector shown in FIG. 2, the cam member 100 is inserted into the nest area 22 of the housing such that the end sections 116 of the cam member 100 reside within the apertures 84 in the housing sidewalls. As installed, the plate portion 110 of the cam member is rotatable between two positive stops, between the positions where the lower surface 112 the plate portion is in contact with the upper surface 32 of the platform 30 and, to a position where the surface 114 of the plate portion 110 is in abutting relation with the slanted surfaces 26 of the housing.

The terminal is then stamped to the configuration shown in FIG. 9 including all three legs 172, 174 and 176, and with the retention arm 168 and contact portion 166 extending at an acute angle relative to the horizontal base section 152. The terminals can then be plated to provide an electrically conductive surface at the contact points 164 and 166. It should be noted that when the terminal is stamped into the configuration of FIG. 9, the contact points 164 and 166 are separated a sufficient distance that the terminals can be adequately plated along the sheared edges of the contacts. Subsequent to the plating process, the retention arm 168 and contact point 166 are rotated in the counterclockwise direction (as viewed in FIG. 9) until the contact point 166 moves into contact with the opposed contact section 164, and is further rotated until the contact portion 164 is slightly deflected thereby preloading the opposed contact portions 164 and 166 together. It should be noted that the section 170 of the terminal is of a reduced cross section relative to the remainder of the terminal which facilitates the bending of the terminal at the precise desired location, and without undue stresses causing cracking. It should also be noted that in the preferred embodiment, the desired material for use with the terminals is a phosphor-bronze alloy which can accommodate such bending. In the preferred embodiment of the invention, the plating is tin plating which has been found to be pliable enough to bend at the section 170 without cracking. Even if some cracking is present, the point which is rotated, that is about point 170, is remote from the contact area and will not effect the electrical characteristics.

After the contacts 150 are formed into their prestressed position as mentioned above, the terminals can be stamped to accommodate either a through hole soldered connection or a surface mount connection. In the preferred embodiment of the through hole soldered connector, the soldered leads are staggered to provide a closer center line spacing of the edge stamped contacts. Thus, while referring to FIG. 9, every other contact 150 would include a solder leg 172 whereas the remainder of the alternate contacts would include a through hole solder leg 174. In the event that a surface mount connector is desired, then each of the solder legs 172 and 174 are sheared clean of the stamped terminal and the surface mount lead 176 is retained.

Figure 5:
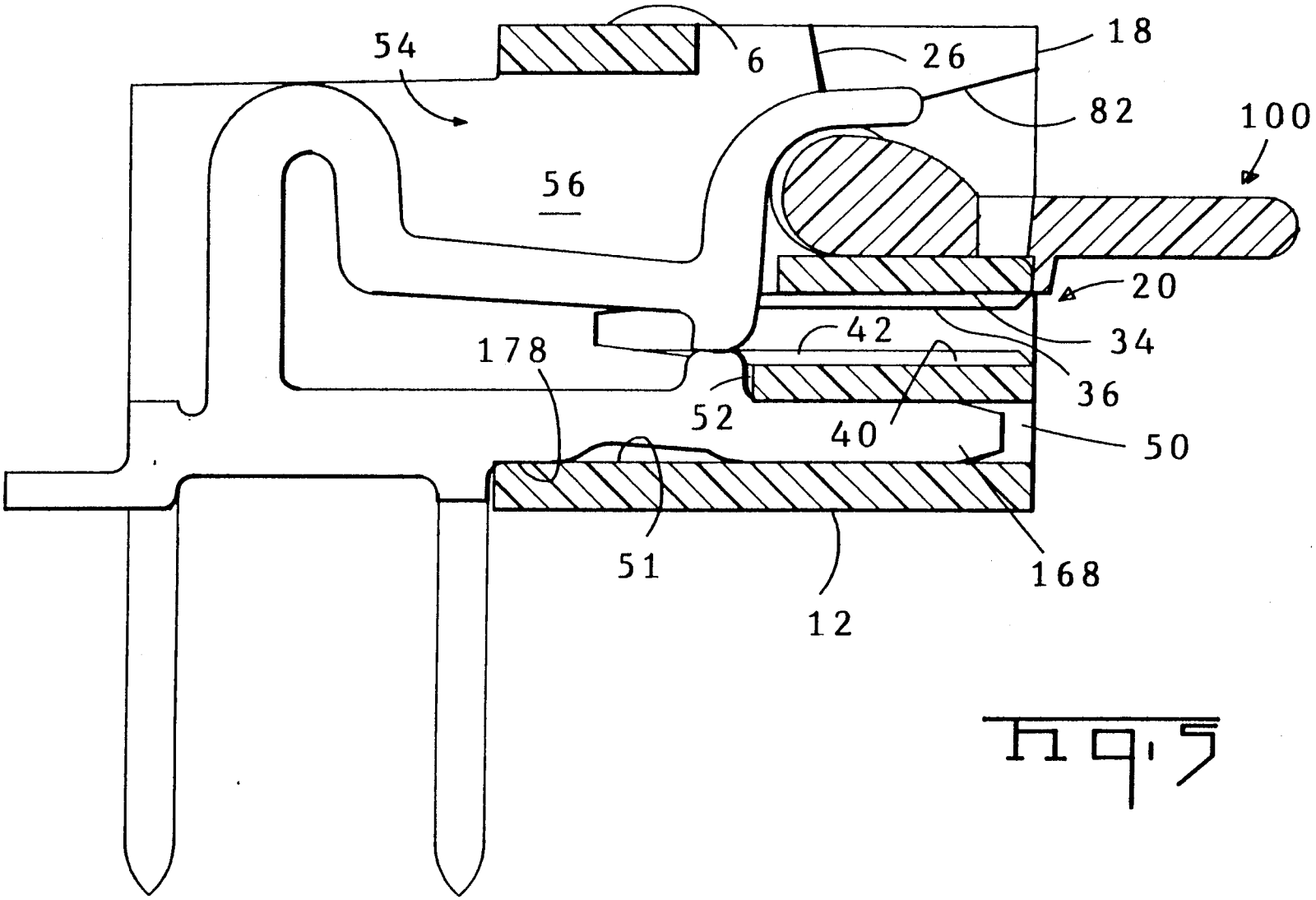
FIG. 5 is a cross-sectional view through lines 5—5 of FIG. 1.

With the terminals stamped and formed as desired, the terminals 150 are insertable into the electrical housing as shown in FIG. 5. The retention arm 168 is receivable into the aperture 50 of the housing and interference fit to retain the terminals in position. Since the retention arm 168 is fixedly mounted within the aperture 50 and with the edge 178 in contact with the lower surface 51 of the aperture 50 as shown in FIG. 5, the opposed contact portions 164, 166 (FIG. 9) will be retained in a prestressed condition. Said differently, the retention arm 168 will have a tendency, when not loaded in the housing, to relieve its original prestressed condition, by rotating in a clockwise direction about pivot point 170. However, the retention arm 168 and the horizontal base section 152 are being rigidly held in a fixed linear position by the aperture 50 which precludes the relaxation between the two opposed portions 164 and 166.

The camming feature, as described herein, has proven to be quite advantageous for use with such small components. For example, the housing shown in FIG. 2 has a height between surfaces 6 and 12 of only 4 millimeters, and the flat flexible cable which in interconnectable to the connector can vary between 0.1 and 0.3 millimeters, with the conductive elements on the cable at centerlines of only 0.025 inches. The first advantage, given the lowest height of the electrical connector, is that an actuator can be used which does not substantially increase the length of the overall connector. This has been accomplished by designing the cam member to have a very high mechanical advantage due to the large rotation angle of the camming member between the two stops as previously described. In order to achieve this high mechanical advantage, windows 108 are provided in the plate member in alignment with each of the cam members. After the lever arm 162 passes over the cam surface 106, the lever arm 162 actually passes through the windows 108 increasing the rotation angle of the camming member, and resultantly, the mechanical advantage.

The windows 108 also provide for the second advantage, that when the cam member 100 is rotated to its full upright position to a position where the levers 162 project through the windows 108 as shown in FIG. 4, the spring force on the upper contact arm 158 due to its deflected position bears on the cam member retaining the cam member in an upward position. This force holds the cam actuator 100 in position, which also holds the contacts to a deflected condition poised for insertion of the cable. This simplifies the ease of insertion of the flat flexible cable given the small space available for access to these connectors. In fact, this detented position allows for insertion of the cable with the use of one hand only, which is sometimes all that there is room for, in these densely filled printed circuit boards.

A third advantage of the camming feature is that a rib 26 is positioned within each of the circular sections 104 which in turn positions each of the cam members 106 within one of the recesses 54 which retains the cam members 106 in side to side alignment with the lever portions 162 of the terminals. This ensures that the lever portions are retained within the recesses 54 and in alignment with the cam portions 105.

Figure 7:
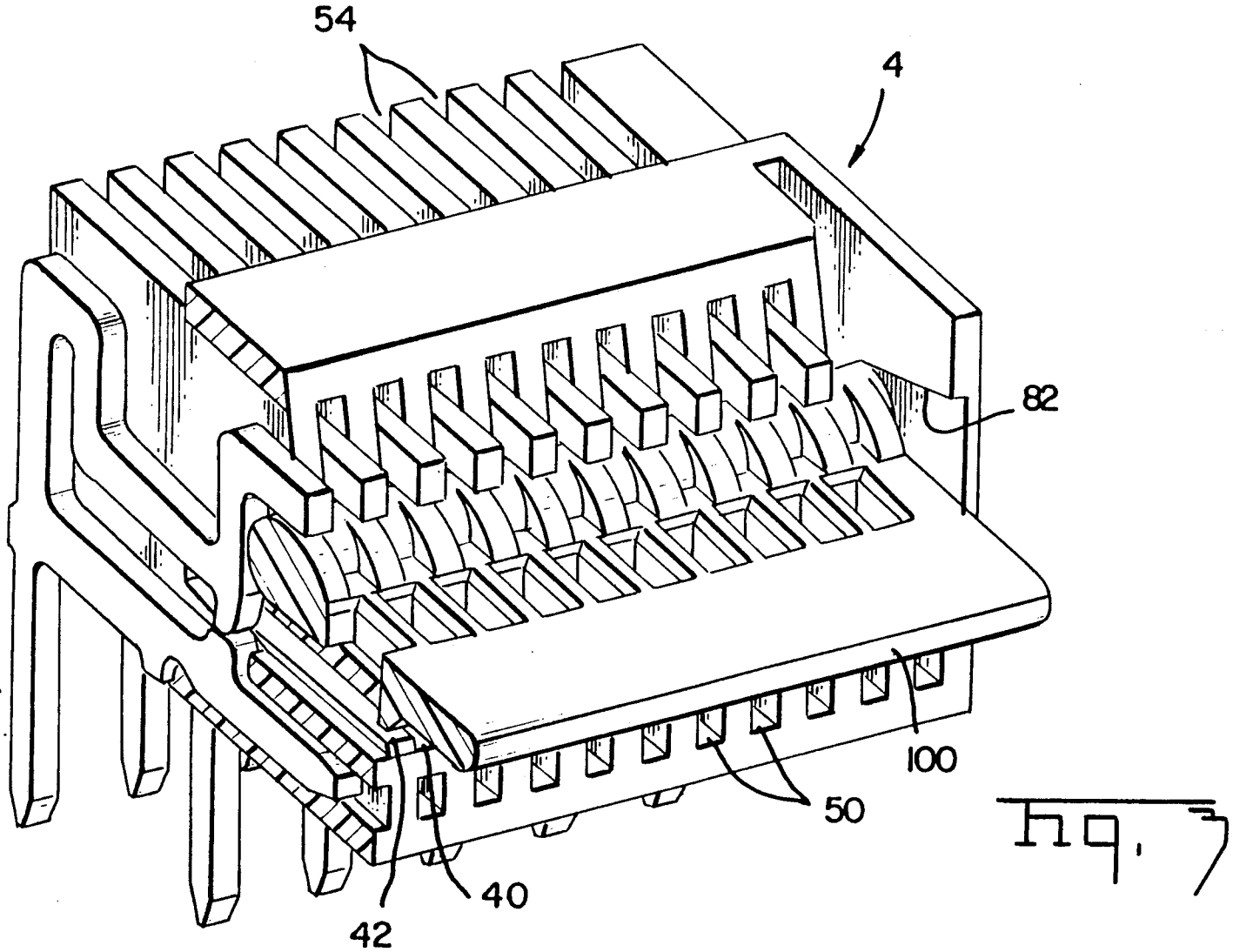
FIG. 7 is a cross-sectional view through lines 7—7 of FIG. 1.

As mentioned above, the connector has been designed for either through hole or surface mounting. When the connector will be used in a surface mount application, a retention feature 200 is used, as shown in FIGS. 1, 2 and 7, which is insertable into the recess 70 and can be latched in place. As best seen in FIG. 7, the retention member 200 includes two bifurcate arms 202 where the lower arm has a latching shoulder, which when in the fully inserted position, can be latched behind a shoulder 204 of the web 29. The retention member 200 includes a foot which can then be soldered to the board which retains the connector in position on the board. It should also be mentioned that a through hole post could also be provided extending from the retention member which is soldered or otherwise latched to the printed circuit board.

Figure 11:
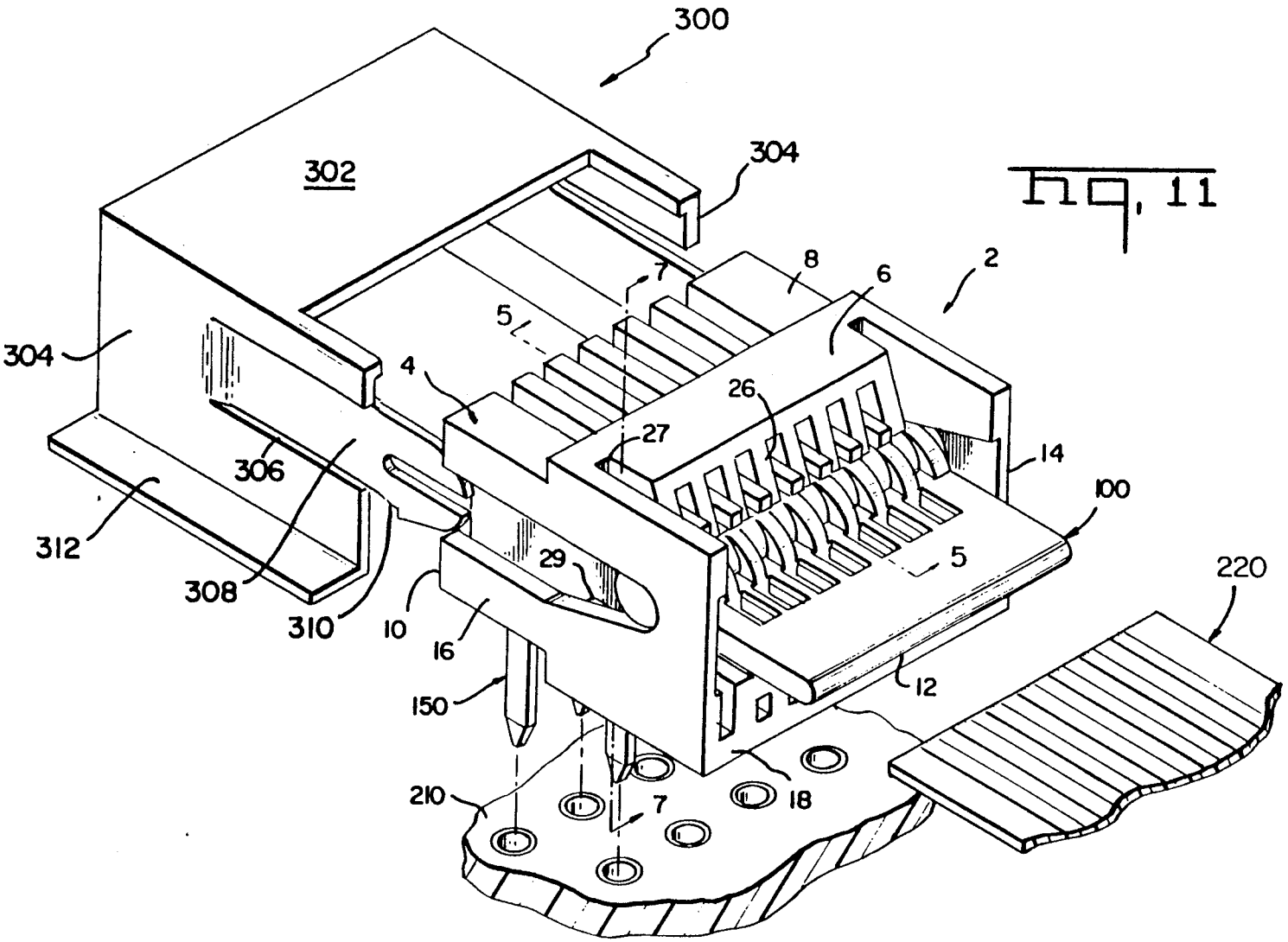
FIG. 11 is an isometric view similar to that of FIG. 1 showing an optional shielded version.

As shown in FIG. 11, a shielded version is available, where the same housing is used for both the shielded and unshielded version. As shown in FIG. 11, an optional shield member 300 can be added to the connector 2, which comprises an upper shield wall 302 and shielding sidewalls 304. A rear shield wall is also provided which extends between the upper wall 302 and between the sidewalls 304, although due to the angle of the isometric view of FIG. 11, the rear wall cannot be seen. To retain the shield to the connector housing 4, two retention arms 308 are provided, which are sheared away from the sidewalls 304 about shear lines 306. The ends of the retention arms 308 include latching features 310 identical to the latching features 202 (FIG. 7), and can be latched to the latching shoulder 204 as shown in FIG. 11. It should be noted that the availability of the shielding version is quite advantageous, and is due to the quite efficient design of the electrical connector shown in FIG. 1. For example, due to the very efficient camming member 100, the camming member is very small dimensionally when compared to the rest of the connector housing. Also, the camming member only operates in a very small portion of the connector housing, leaving the rest of the connector housing to be shielded. It should be appreciated that the shield member shown in FIG. 11 could also include such features as through hole posts which are connectable to ground traces on the printed circuit boards.

Figure 12:
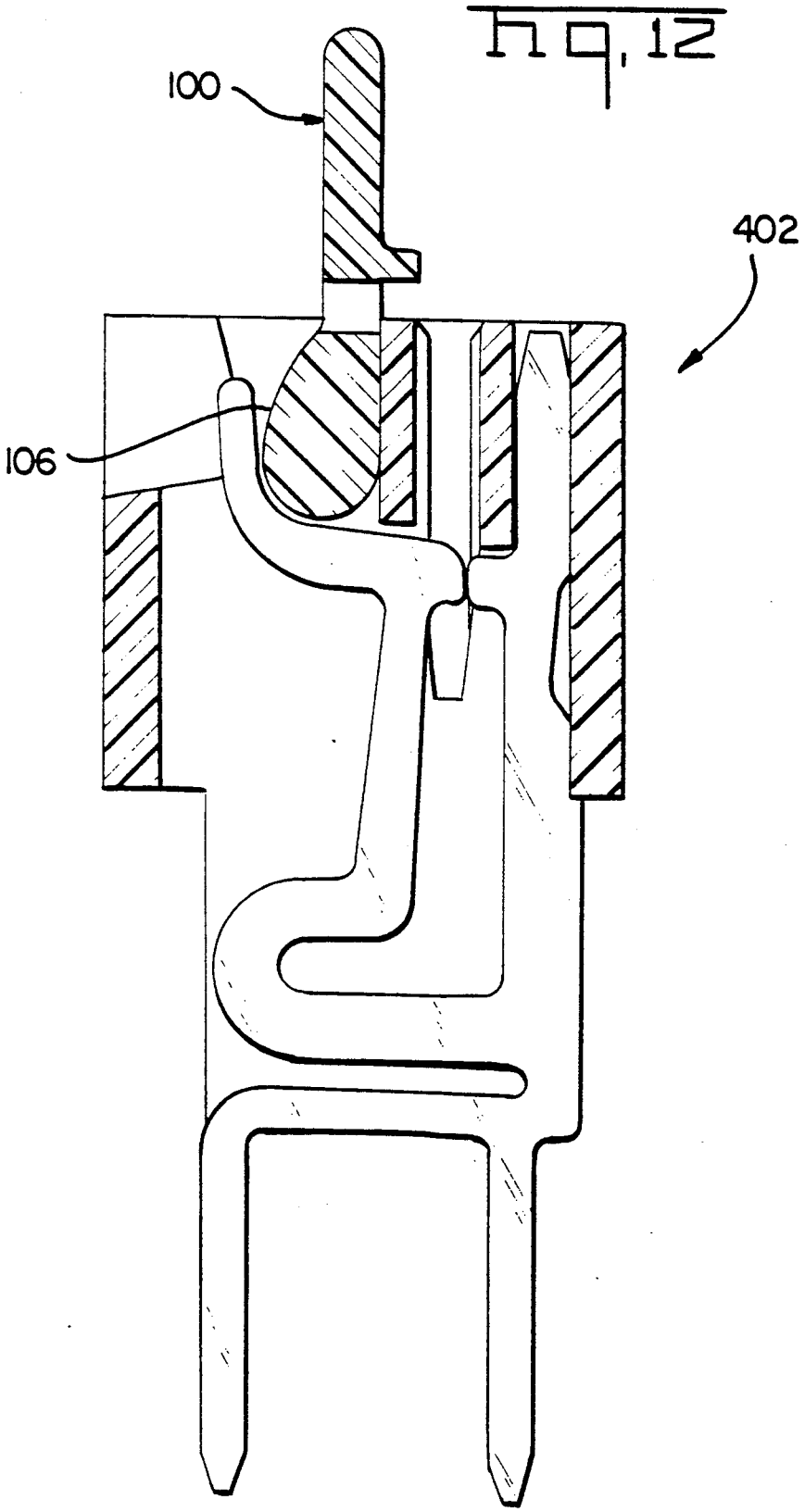
FIG. 12 is a cross-sectional view of an alternate embodiment where the connector is vertically arranged and for through hole printed circuit board mount.

As shown in FIGS. 12 and 13, although the horizontal version shown in FIGS. 1-10 is the preferred version, again due to the efficient design of the electrical connector, a vertical version of the connector is available which can be formed by using the same housing as the horizontal version. All that needs to be changed is the terminal configuration as shown in FIGS. 12 and 13.

Thus, with the efficient design of the electrical connector, the exact same housing can be used with several differently configured systems. For example, the cam member of the electrical connector is very small relative to the remainder of the connector due to the high mechanical advantage of the connector. Furthermore, the connector can be configured as a horizontal through hole version, a horizontal surface mount version, a vertical through hole version or a vertical surface mount version. Also, the terminals are designed such that the same stamping for the horizontal version, and the same terminal stamping for the vertical version can be used to make either the through hole or surface mount connector. Finally, any of the above mentioned configurations can be electrically shielded.

Figure 14:
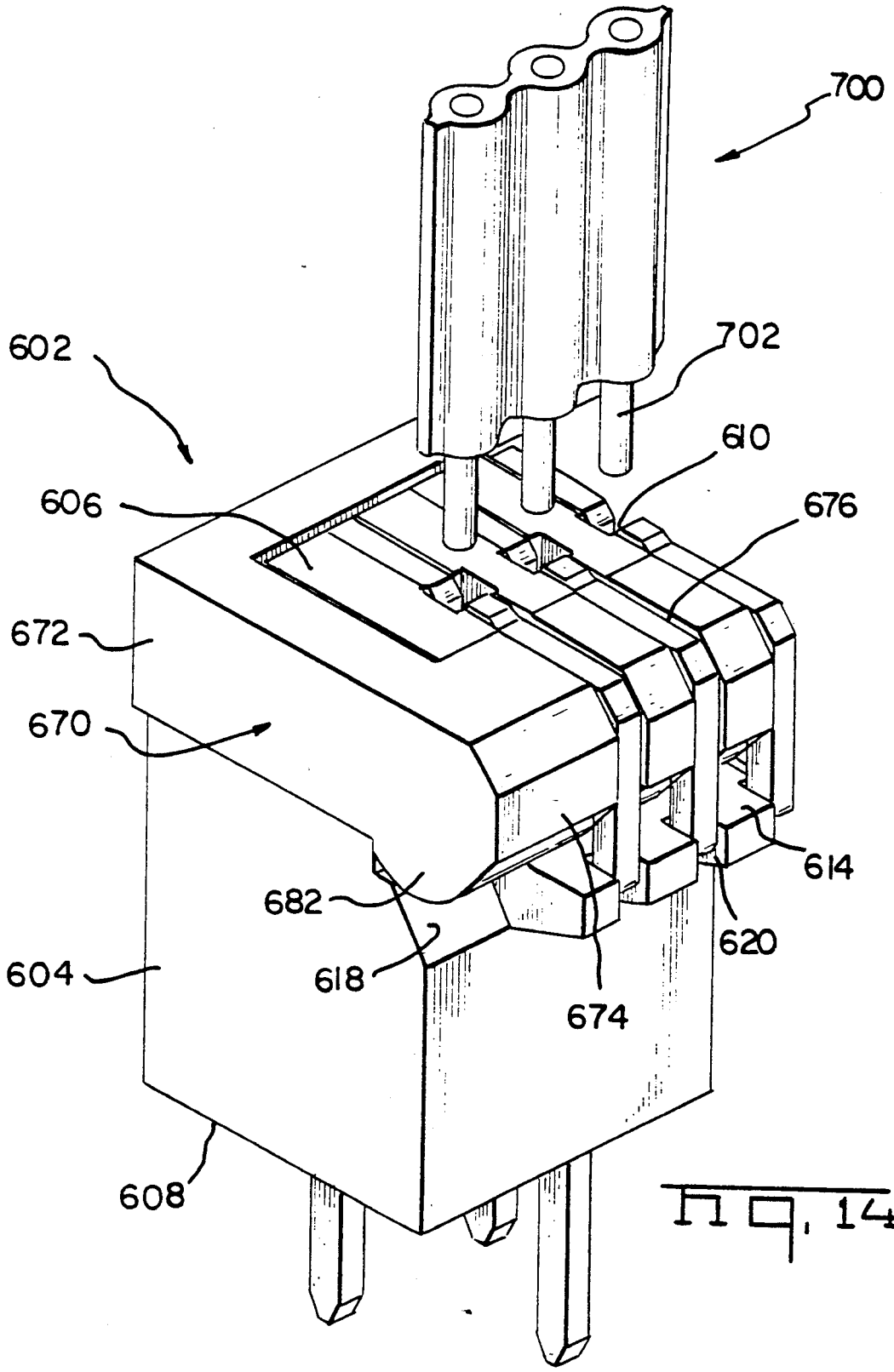
FIG. 14 is an isometric view of an embodiment of the connector for multi-conductor cable.
Figure 15:
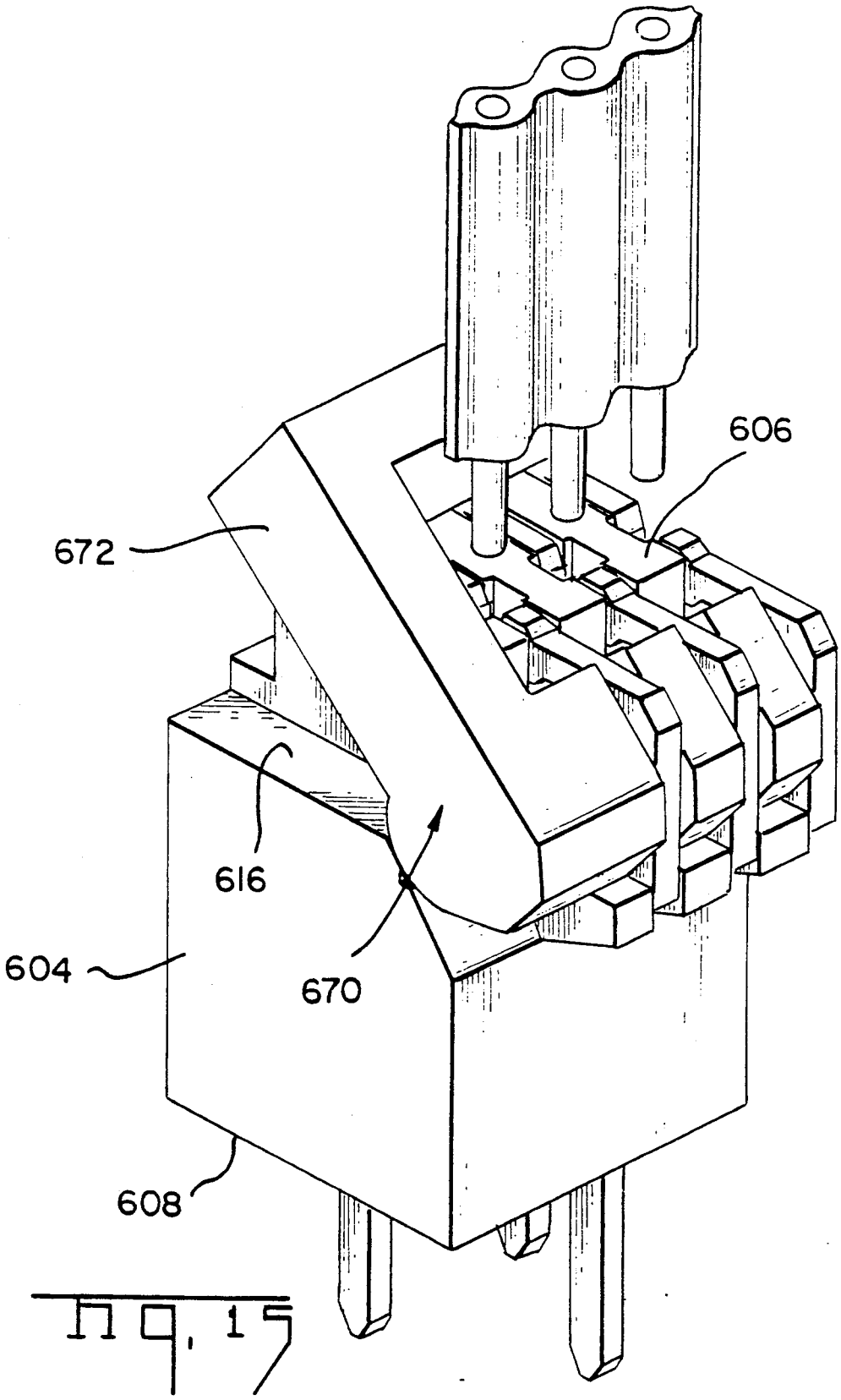
FIG. 15 is an isometric view similar to that of FIG. 14 showing the cam arm in position with the contacts opened to provide a zero insertion force entry of the conductors.

With reference now to FIGS. 14 and 15, the instant invention can also be used to connect the conductors 702 of a flat ribbon cable 700 to printed circuit board traces on the printed circuit board. The electrical connector which is shown generally as 602 generally comprises an insulating housing 604, a plurality of terminals 630, and a cam member 670.

Figure 16:
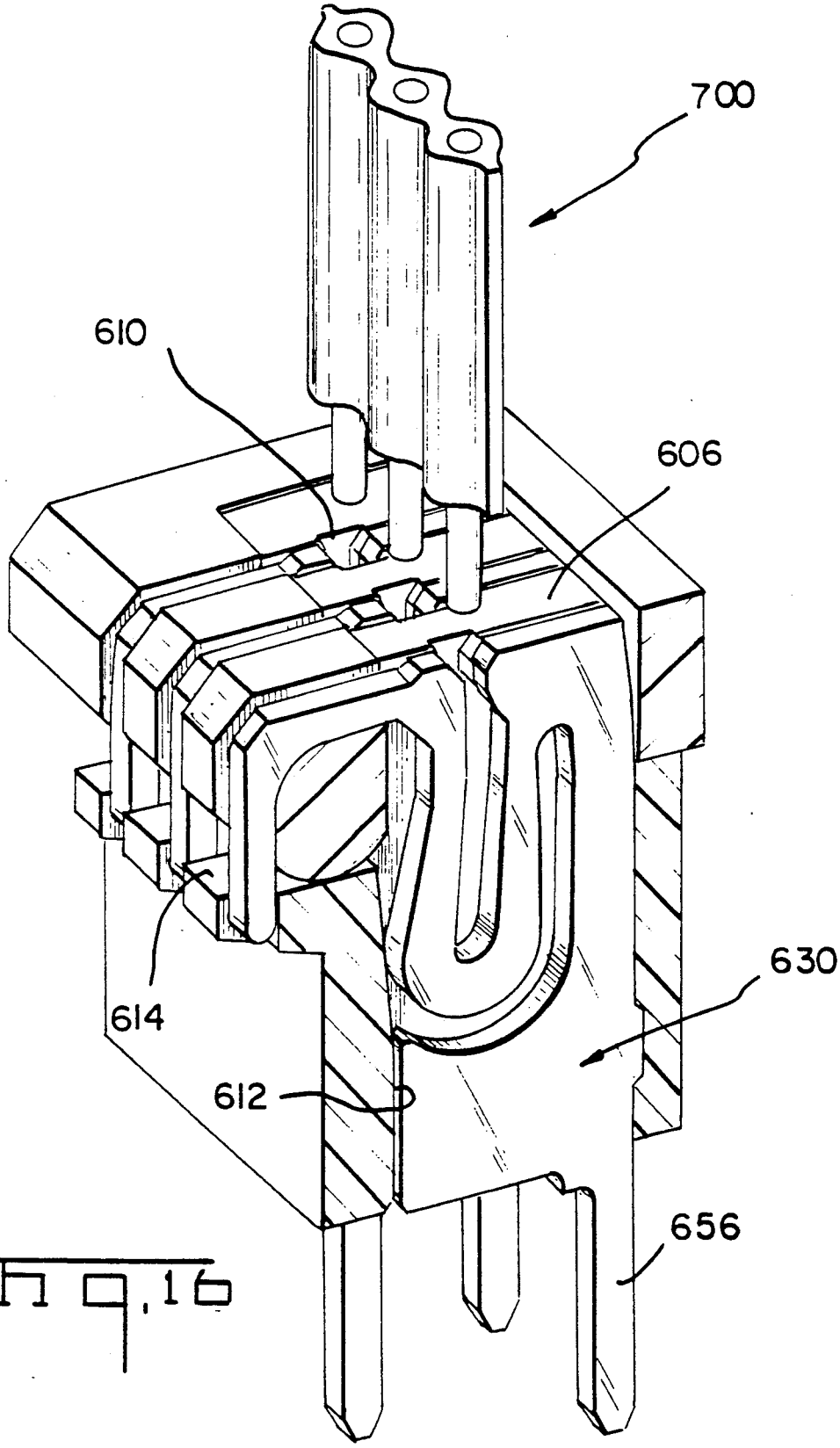
FIG. 16 is a view similar to that of FIG. 14 showing an isometric cutaway view.
Figure 17:
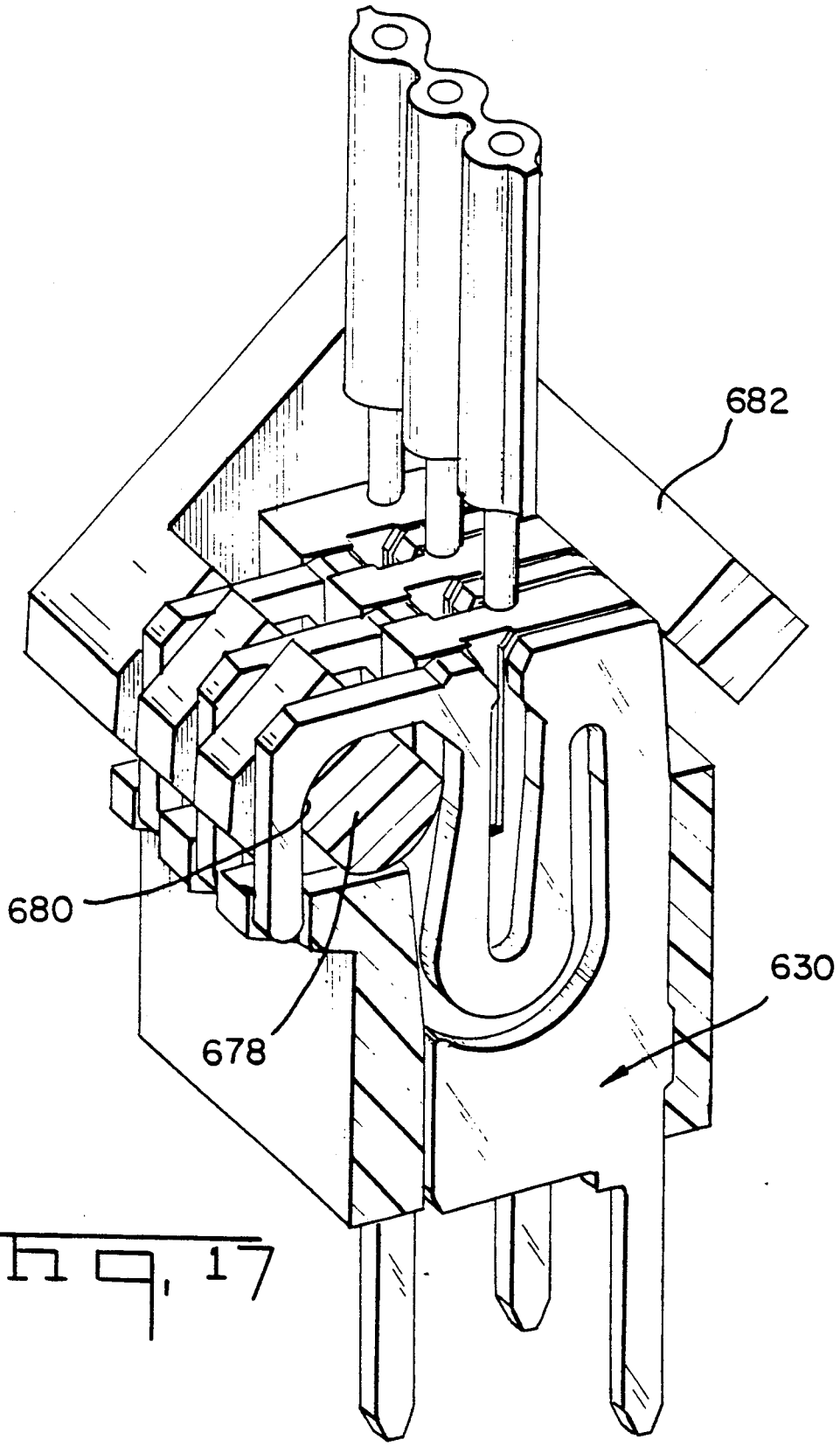
Figure 16:
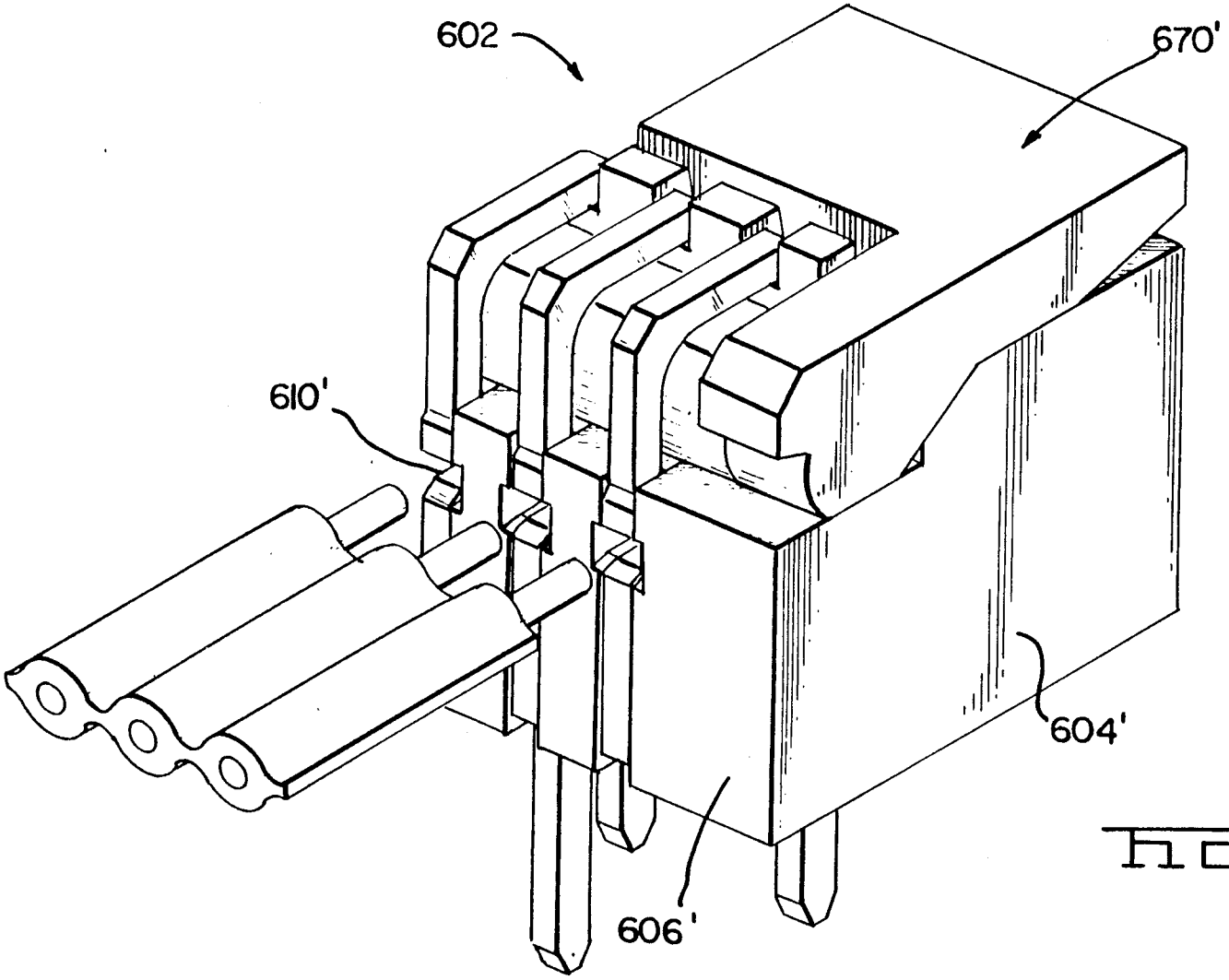
Figure 19:
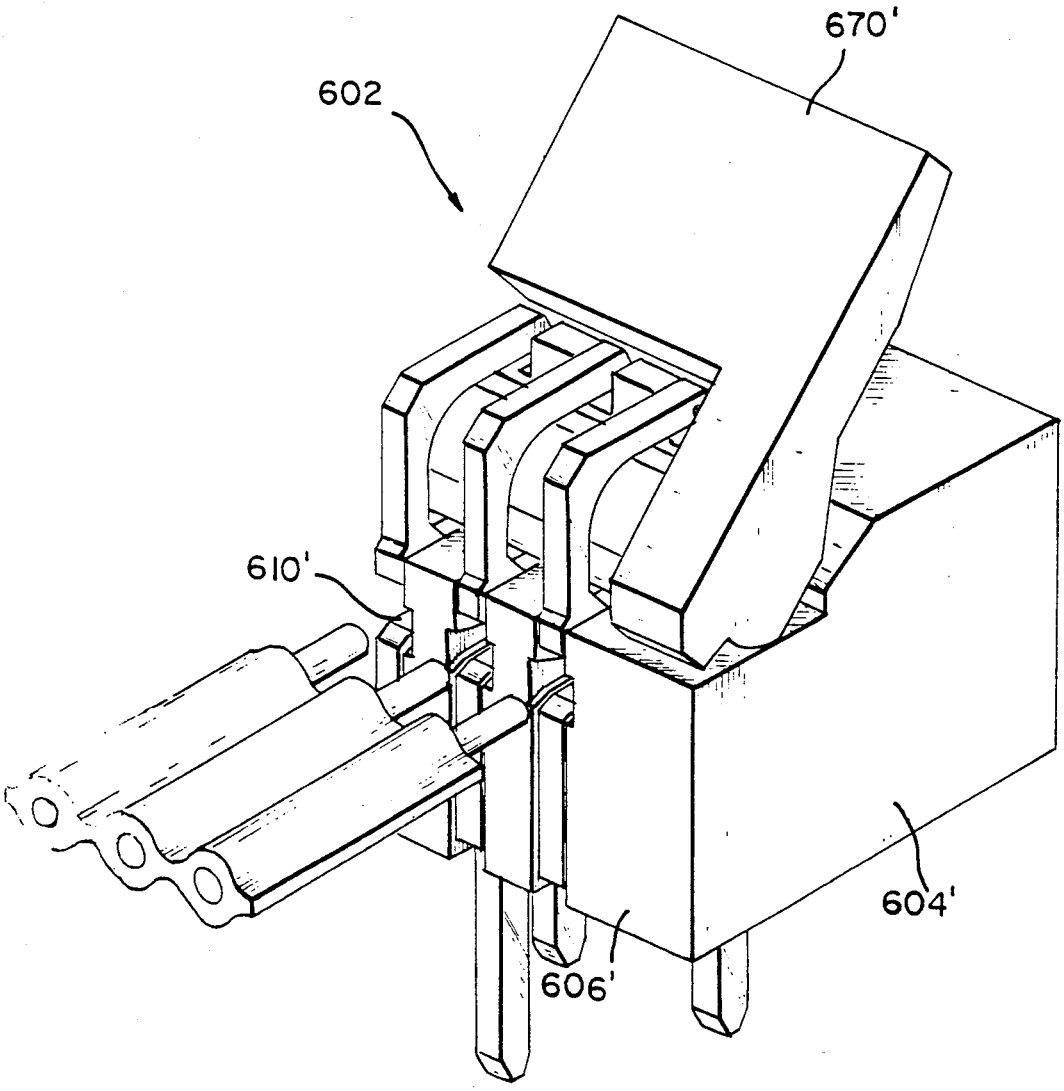
FIG. 19 is a view similar to that of FIG. 18 showing the cam arm in a lifted position for entry of the conductors.
Figure 20:
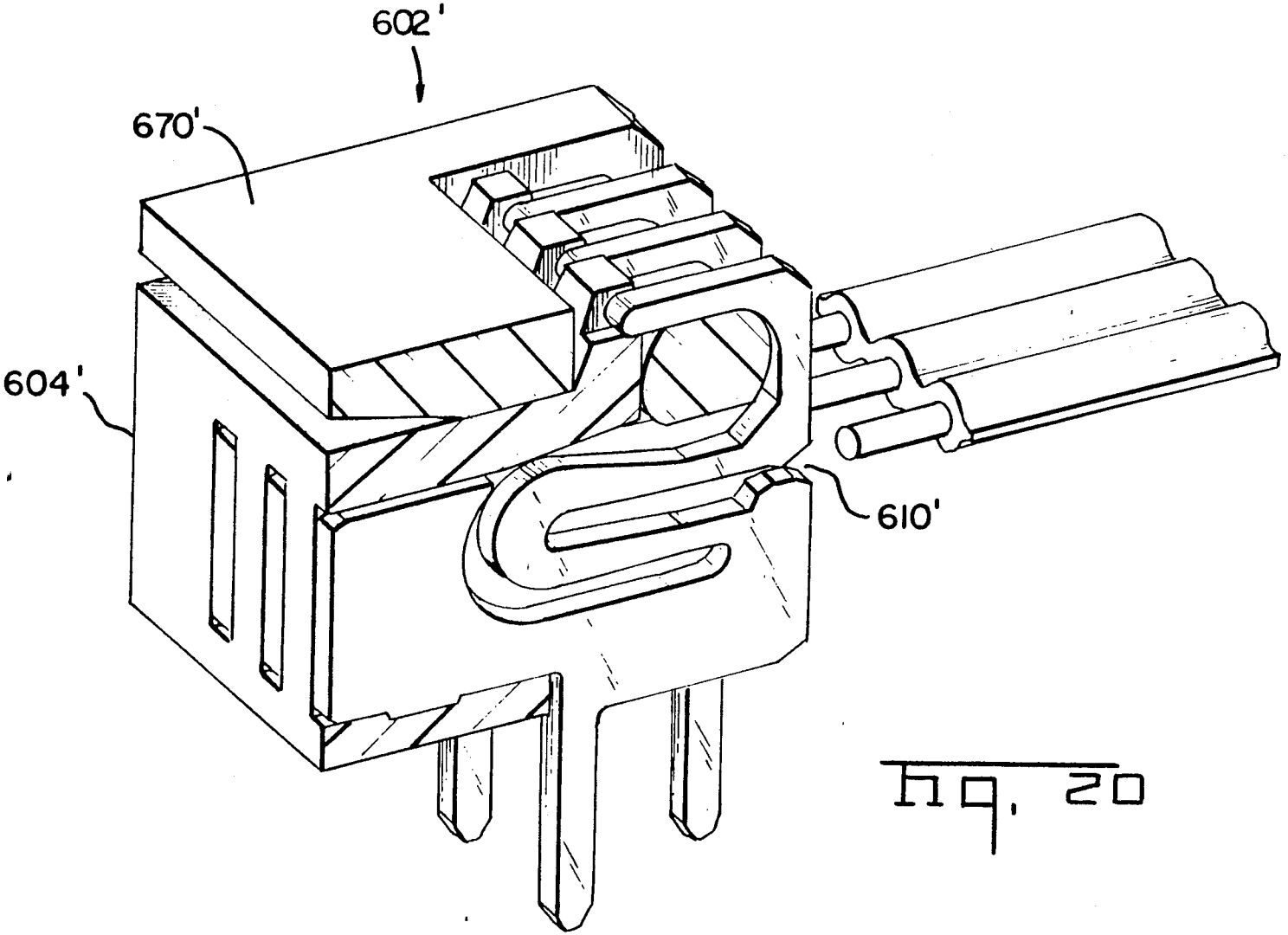
FIG. 20 is a view similar to that of FIG. 18 showing an isometric cutaway of the connector showing the cam arm prior to actuation.
Figure 21:
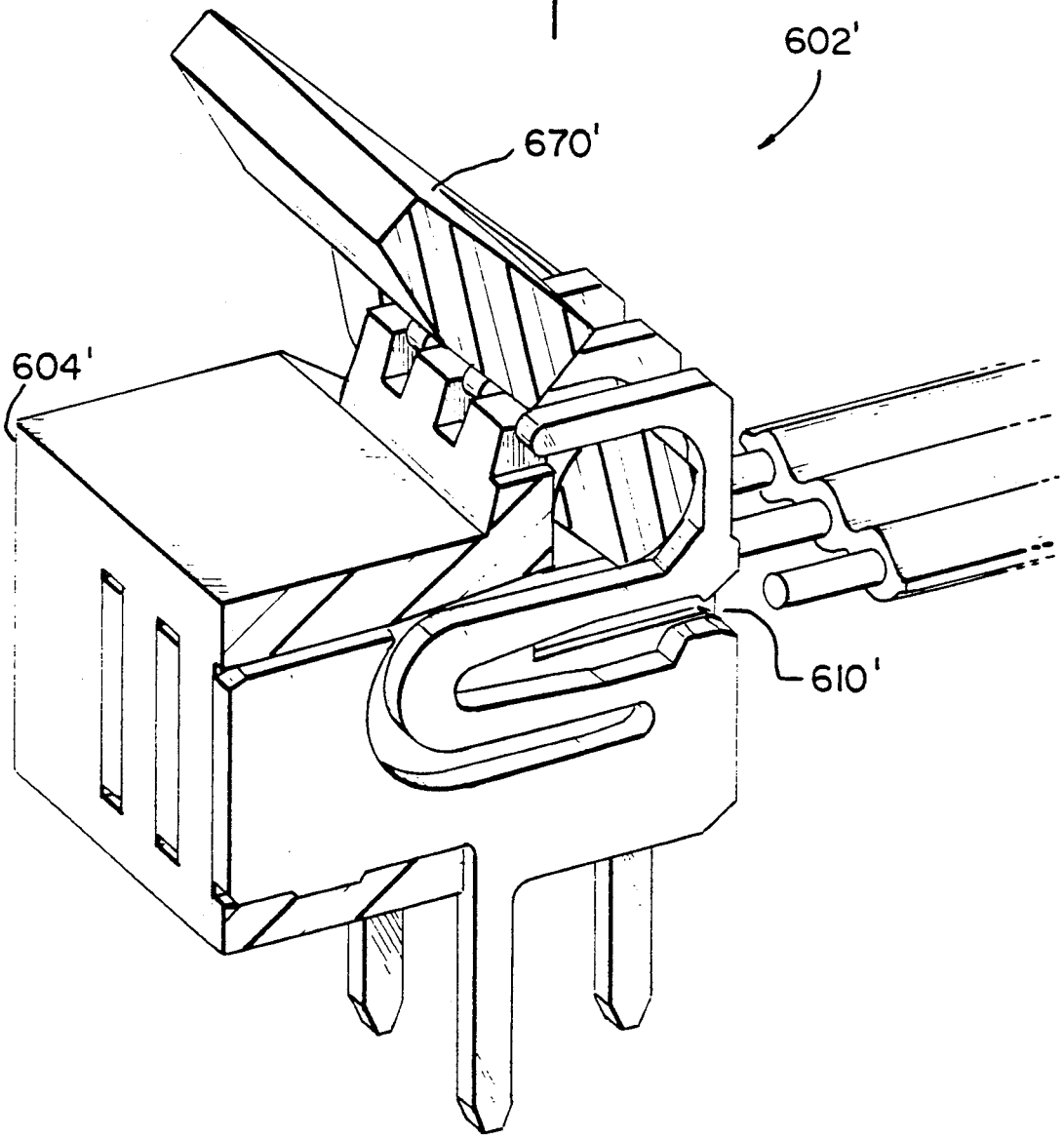
FIG. 21 is a view similar to that of FIG. 20 showing the cam arm actuated with the terminal in an open position for entry of the conductors.
Figure 21:
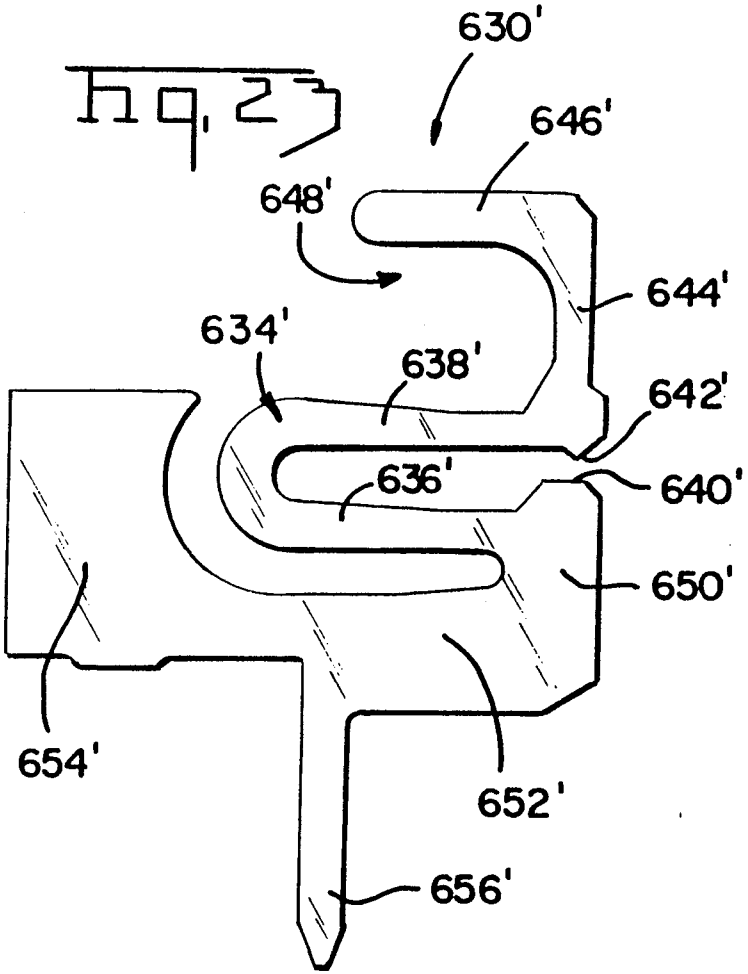

Referring still to FIGS. 14 and 15, the housing 604 generally includes a wire receiving face 606 and a mounting face 608 for abutment to the printed circuit board. The wire receiving face 606 includes a plurality of wire receiving openings 610 which communicate with terminal receiving cavities 612, as shown in FIG. 16. The housing 604 further comprises a ledge 614 which extends from a front side of the housing where the ledge includes a plurality of side by side channels 620. As shown in FIG. 15 the top surface of the housing 604 includes a profiled recess 616.

Figure 22:
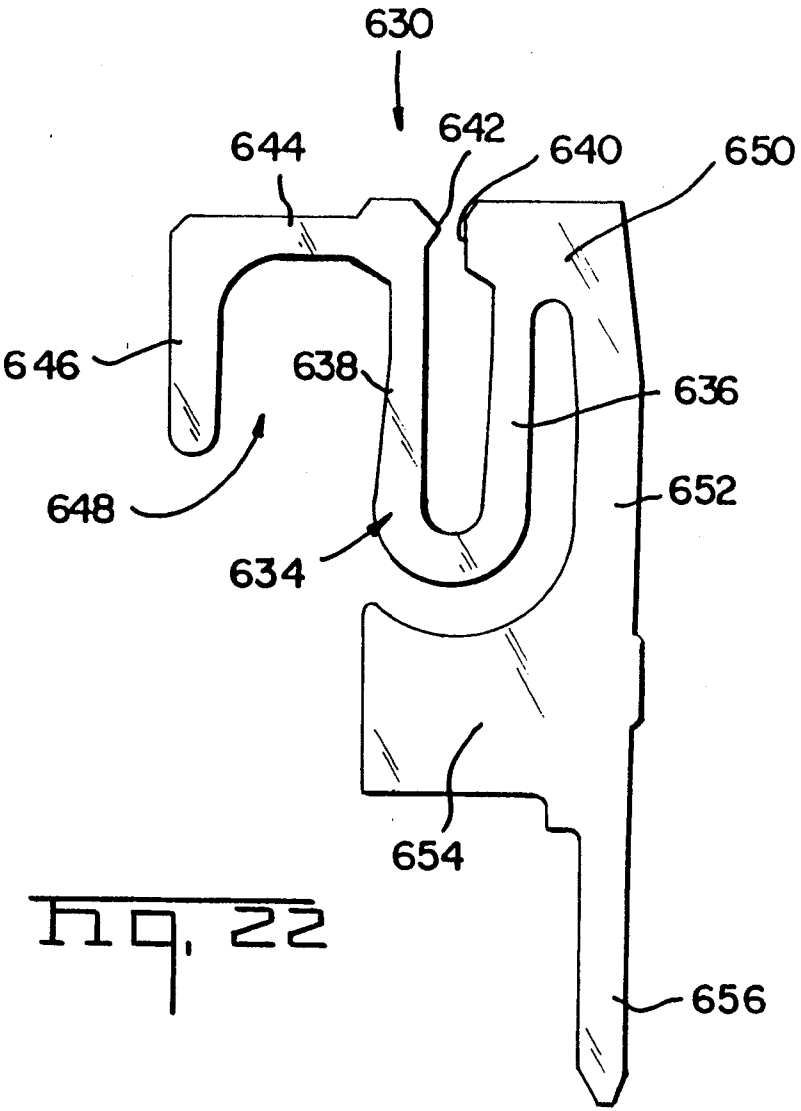
FIG. 22 is a flat plan view of the terminal of the first embodiment.

With reference now to FIG. 22 the terminal 630 will be described in greater detail. The terminal 630 generally includes a first U-shaped portion 634 defined by a first arm 636 and a second arm 638. At the free ends of the first and second arm 636 and 638 respectively are wire contacting portions 640 and 642. A second U-shaped portion 648 is defined by a third arm 646 being interconnected to the second arm via a bight portion 644 thereby using the second arm as a common integer in the second U-shaped portion 648. The first 634 and second 648 U-shaped portions are commonly interconnected to the remainder of the terminal via a web portion 650 which interconnects the two U-shaped portions to a leg 652. The leg is integrally interconnected to the body 654 which has printed circuit board posts 656 extending downwardly therefrom.

Figure 17:
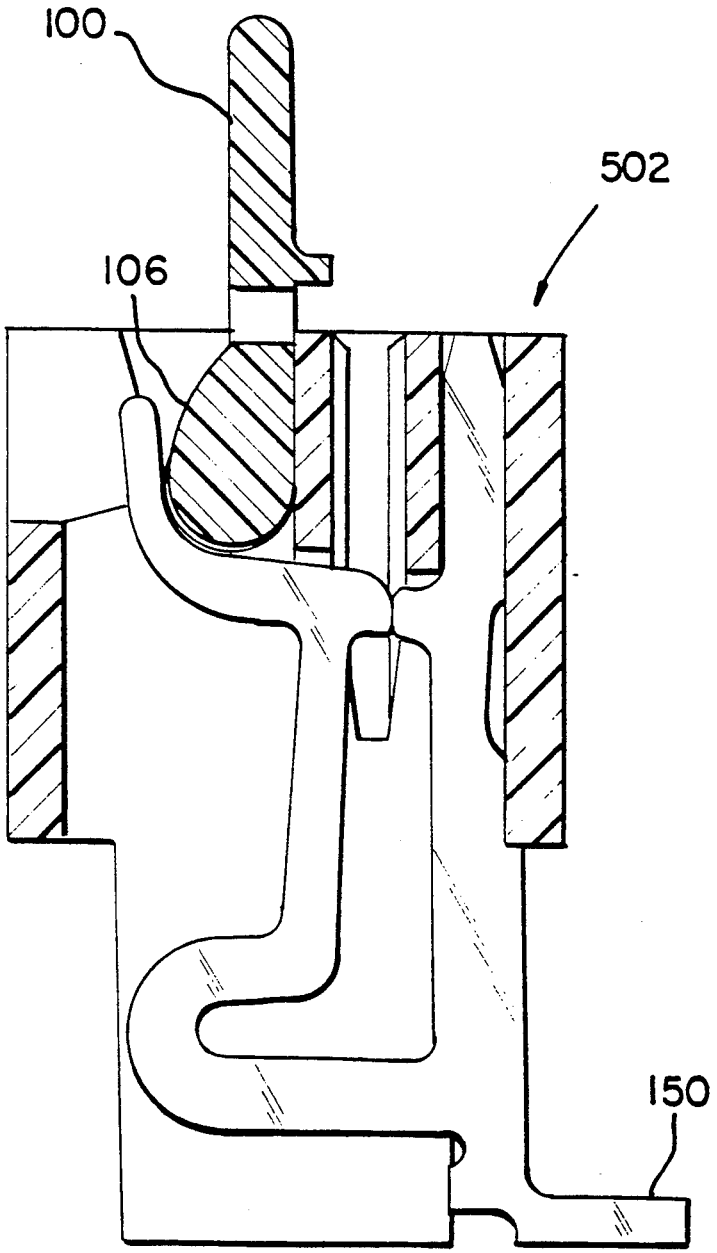
FIG. 17 is a view similar to that of FIG. 15 showing an isometric cutaway with the cam arm in a lifted position.

With reference again to FIG. 14 the cam member 670 includes an arm portion 672 interconnected to a horizontal shaft 674 which extends across the front face of the connector member. The horizontal shaft includes a plurality of grooves 676 along the width of the shaft with cam portions located in each of the grooves. As best shown in FIGS. 16, 17, 18 and 19 the cam member is generally circular in shape yet includes two flat parallel sections removed from the cylinder along an axial length thereof to form an eccentric at position 680 as shown in FIG. 17.

To assemble the connector 602, the cam member 670 is positioned on the housing 604 such that the arm 672 resides within the recess 616 and such that the shaft is resting or is positioned on the mandrel 614. The terminals 630 are then inserted from and through the upper face 606 into associated terminal receiving cavities 612 until such time as the posts 656 protrude through the lower face 608 and until such time as the upper edges of the terminals 630 are flush with the upper face 606 of the connector housing. As shown in FIG. 16, the second U-shaped portion of the terminal overlaps the horizontal shaft portion and is actually used to retain the cam member 670 in place. Also the free ends of the third arm 646 are located in associated grooves 620 to prevent side to side movement of the terminals and the cam member 670. It should be appreciated by one skilled in the art that this combination of components provides a simplistic yet very functional electrical connector as the terminals themselves are used to retain the cam member in place thereby precluding the necessity for latching or retention means between the cam member and the housing, thereby preventing the requirement for sophisticated molding equipment.

With reference to FIGS. 16 and 17 the electrical connector can be used to interconnect solid conductors of a multi-conductor cable such as 700 to printed circuit board traces by simply moving the handle from a first position shown in FIG. 16 to a second position shown in FIG. 17. When in the position shown in FIG. 16 the flat side of the cam 678 is adjacent and parallel to the third leg portion 646 of the terminal. When the cam member is moved to the position shown in FIG. 17 the eccentric portion 680 contacts the third leg 646 which spreads the first and second legs 636 and 638 thereby provides a spaced apart relation between the two contacting parts 640 and 642.

It should be understood that the electrical terminal and cam arrangement is profiled such that the spaced apart relation between the contacting points 640 and 642 is spread to a position to allow the insertion of the bare conductor without the conductor requiring an insertion force therebetween, commonly referred to as a zero insertion force (ZIF) connector. When the conductors 702 are fully inserted between the contacting points 640 and 642, the cam member 670 can be returned to the first position shown in FIGS. 14 or 16 thereby placing the contact points 640 and 642 in electrical connection with the conductor. It should also be understood that the natural or free state of the electrical terminal as shown in FIG. 22 is such that the spaced apart relation between the contacting points 640 and 642 is smaller than the diameter of the conductor to be contacted.

Therefore, when a conductor is placed between the two contacting parts the U-shaped portion 634 and the two arms 636 and 638 provide a stored energy electrical connection with the conductor 702. It should also be noted from FIG. 17 and FIG. 22 that due to the shape of the electrical terminal 630, the movement of the spring does not in affect the electrical integrity of the interconnection between the posts 656 and the printed circuit board. As shown in FIG. 22, the leg portion 636 and the entire first U-shaped portion 634 are isolated from the body of the terminal 652, that is the U-shaped portion 634 is only interconnected to the leg portion 652 of the terminal via the web 650. This allows the U-shaped portion 634 to be flexible relative to the remainder of the terminal during the camming operation of the first U-shaped portion.

Another embodiment of the invention is shown in FIGS. 18 through 21 and the flat blank of the terminal is shown in FIG. 23. Each of the embodiments include virtually identical components therefore the respective components of the second embodiment are designated with primed numbers. The primary distinguishing feature between the first and second embodiments is that the second embodiment includes a wire receiving face 606' allowing the multi-conductor cable to be inserted in a horizontal plane toward the connector rather than in a vertical plane in the first embodiment. Advantageously the terminal was designed such that the same die could be used for the first and second embodiments with the only change being the location of the posts 656 or 656', as the case requires.

We claim:

1. An electrical connector comprising an insulating housing having a plurality of terminal receiving passageways for receiving a like plurality of electrical terminals, the housing further comprising a mating force for receipt of a plurality of electrical conductors, the terminals each including a fixed contact arm and a movable spring arm, where each of the arms contains an opposed contact portion for contacting the electrical conductors and a lever portion integrally formed with the movable spring arm which can be lifted by an actuator member to open the opposed contact portions, the connector being characterized in that:

the housing includes an open nest area proximate to the mating face with the lever sections extending over the open nest area, and in that the actuator member is defined as a cam shaft having a shaft portion and eccentric cam portions, the cam shaft being positioned within the open nest area and rotatable therein in continuous slidable engagement against the open nest area, the lever portions extending over the cam shaft eccentric cam portions and being adapted for slidable engagement against the eccentric cam portions upon rotation of the cam shaft, the cam shaft being rotatable from an initial angle where the lever is proximate to the shaft portion, through an angle where the eccentric cam portions slidably engage the lever portions and raise the movable spring arm to take the opposed contact portions out of contact with each other.

2. The electrical connector of claim 1 characterized in that the electrical terminals are edge stamped from sheet metal.

3. The electrical connector of claim 1, characterized in that the lever portions of the electrical terminals are disposed forward of the opposed contact sections and projects towards the mating face.

4. The electrical connector of claim 1 characterized in that the lever portions are projecting in the opposite direction from the mating face, and together with the spring portions form U-shaped sections, where the cam member is positioned in the U-shaped section.

5. The electrical connector of claim 4, characterized in that the actuator member further comprises a rotatable plate fixed to the cam shaft.

6. The electrical connector of claim 5, characterized in that the plate section of the cam member includes a plurality of windows through the plate, each said window being aligned with a respective lever section, such that rotation of the plate towards the ends of the lever sections allows the lever sections to pass through the windows, increasing the allowable rotation angle.

7. The electrical connector of claim 1, characterized in that the cam shaft includes a plurality of individual cam sections with the lever sections.

8. An electrical connector for the electrical interconnection of the first conductors to second conductors, the connector comprising:

an insulating housing having a mating face and a mounting face, the mating face having opening means therein for the receipt of a plurality of first conductors, a plurality of terminals mounted within the housing within terminal passageways located within the housing, each terminal including a base spring arm which is proximate to the mounting face and a movable spring arm which is essentially parallel to the base spring arm, the base spring arm and the movable spring arm having opposed contact members located thereon for receiving the plurality of conductors therebetween in an electrically conductive manner, the electrical terminal further comprising a lever section which extends from the movable spring arm and extends towards the mating face, an actuator member which is mounted adjacent to the mating face and is rotatable relative to the housing, the actuator member having a cam shaft which includes a shaft section having located thereon, a plurality of eccentric cam lobes, the actuator member further comprising a plate member extending integrally from the cam shaft, and being adapted for rotation of the cam shaft, where each eccentric cam lobe is aligned with one of the lever sections of the terminals, the eccentric cam lobes being adapted to engage the lever sections upon rotation of the plate member to lift the movable spring arm away from the base spring arm and open the opposed contact sections.

9. The connector of claim 8 wherein the actuator member comprises an opening means through the plate member and above the eccentric cam lobes, the plate member being movable towards the lever portions to a position where the lever sections extend through the opening means to increase the allowable rotation angle of the plate member.

10. The connector of claim 9 wherein the plate section opening means includes a plurality of windows extending therethrough and aligned with the lever sections, and the actuator is movable from a position where the lever sections are unuactuated to positions where the lever sections are lifted by the eccentric cam lobes, with the lever sections extending through and engaging the windows thereby locking the opposed contact members in an open position.

* * * * *

UNITED STATES PATENT AND TRADEMARK OFFICE

CERTIFICATE OF CORRECTION

PATENT NO. : 5,173,058

DATED : December 22, 1992

INVENTOR(S) : Johannes M. Broeksteeg, et al.

It is certified that error appears in the above-identified patent and that said Letters Patent is hereby corrected as shown below:

In claim 1, column 10 line 55, change "force" to --face--.

Signed and Sealed this

Sixteenth Day of November, 1993

Bruce Lehman

*Attest:*

BRUCE LEHMAN

*Attesting Officer*

*Commissioner of Patents and Trademarks*